US007097287B2

(12) United States Patent
Nakao et al.

(10) Patent No.: US 7,097,287 B2
(45) Date of Patent: Aug. 29, 2006

(54) INK JET DEVICE, INK JET INK, AND METHOD OF MANUFACTURING ELECTRONIC COMPONENT USING THE DEVICE AND THE INK

(75) Inventors: Keiichi Nakao, Osaka (JP); Hideyuki Okinaka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 28 days.

(21) Appl. No.: 10/343,242

(22) PCT Filed: May 8, 2002

(86) PCT No.: PCT/JP02/04471

§ 371 (c)(1),
(2), (4) Date: Oct. 8, 2003

(87) PCT Pub. No.: WO02/090117

PCT Pub. Date: Nov. 14, 2002

(65) Prior Publication Data

US 2004/0061747 A1 Apr. 1, 2004

(30) Foreign Application Priority Data

May 9, 2001 (JP) ..... 2001-138141

(51) Int. Cl.
*B41J 2/175* (2006.01)
*B41J 2/19* (2006.01)

(52) U.S. Cl. ..... 347/85; 347/92

(58) Field of Classification Search ..... 347/10, 347/56, 61, 63, 65, 67, 84–87, 89–90, 92–93, 347/20

See application file for complete search history.

(56) References Cited

U.S. PATENT DOCUMENTS

| | | | | |
|---|---|---|---|---|
| 3,889,270 | A | 6/1975 | Hoffmann et al. | 347/105 |
| 4,150,997 | A | 4/1979 | Hayes | 106/15.05 |
| 4,322,698 | A | 3/1982 | Takahashi et al. | 333/184 |
| 4,586,972 | A | 5/1986 | Yokotani et al. | 156/89.12 |
| 4,894,092 | A | 1/1990 | Nishihara et al. | 106/452 |
| 4,929,963 | A * | 5/1990 | Balazar | 347/89 |
| 4,959,247 | A | 9/1990 | Moser et al. | 427/126.5 |

(Continued)

FOREIGN PATENT DOCUMENTS

EP 0 736 388 10/1996

(Continued)

OTHER PUBLICATIONS

"Ink Jet Printing Technology and Materials" by Takeshi Amari, pp. 202-206, CMC Publishing Co., 1998.

*Primary Examiner*—Juanita D. Stephens
(74) *Attorney, Agent, or Firm*—Wenderoth, Lind & Ponack, L.L.P.

(57) ABSTRACT

Here disclosed is an ink jet apparatus having an ink-circulating/dispersing function. The apparatus provides ink with dispersion as required, and circulates the ink through a tube to an ink-collecting tank. During this circulation, a required amount of the ink is fed to a printer head to form a predetermined pattern on a surface of a substrate. By virtue of the circulating/dispersing function, the apparatus can cope well with easy-to-aggregate ink having poor stability in terms of printing, thereby protecting a printer head or an ink-spouting section from clogging during ink jet printing. Such stabilized ink jet printing contributes to manufacturing highly reliable electronic components with an increased yield of products.

18 Claims, 16 Drawing Sheets

U.S. PATENT DOCUMENTS

| | | | | |
|---|---|---|---|---|
| 5,034,244 | A | 7/1991 | Berrer et al. | 427/511 |
| 5,273,575 | A | 12/1993 | de Saint Romain | 106/31.05 |
| 5,407,474 | A | 4/1995 | Airey et al. | 106/31.05 |
| 5,567,328 | A | 10/1996 | Engle et al. | 347/1 |
| 5,710,585 | A * | 1/1998 | Sabonis et al. | 347/86 |
| 5,714,236 | A | 2/1998 | Withington et al. | 347/106 |
| 5,963,237 | A * | 10/1999 | Ikkatai et al. | 347/85 |
| 6,039,442 | A | 3/2000 | Hagiwara et al. | 347/89 |
| 6,487,774 | B1 | 12/2002 | Nakao et al. | 29/890.1 |
| 6,557,987 | B1 * | 5/2003 | Shibata et al. | 347/84 |
| 6,604,816 | B1 | 8/2003 | Yonekura et al. | 347/54 |

FOREIGN PATENT DOCUMENTS

| | | |
|---|---|---|
| EP | 0 988 968 | 3/2000 |
| EP | 1 083 053 | 3/2001 |
| JP | 48-81057 | 10/1973 |
| JP | 54-139531 | 10/1979 |
| JP | 56-94719 | 7/1981 |
| JP | 58-50795 | 3/1983 |
| JP | 59-82793 | 5/1984 |
| JP | 60-175050 | 9/1985 |
| JP | 62-218460 | 9/1987 |
| JP | 63-283981 | 11/1988 |
| JP | 1-226130 | 9/1989 |
| JP | 1-226134 | 9/1989 |
| JP | 2-65112 | 3/1990 |
| JP | 2-284678 | 11/1990 |
| JP | 3-033172 | 2/1991 |
| JP | 5-202326 | 8/1993 |
| JP | 5-229140 | 9/1993 |
| JP | 5-261934 | 10/1993 |
| JP | 5-262583 | 10/1993 |
| JP | 5-263028 | 10/1993 |
| JP | 7-211507 | 8/1995 |
| JP | 7-330473 | 12/1995 |
| JP | 8-64407 | 3/1996 |
| JP | 8-102401 | 4/1996 |
| JP | 8-102402 | 4/1996 |
| JP | 8-102403 | 4/1996 |
| JP | 8-127747 | 5/1996 |
| JP | 08-222475 | 8/1996 |
| JP | 9-219339 | 8/1997 |
| JP | 9-232174 | 9/1997 |
| JP | 2000-94706 | 4/2000 |
| JP | 2000-182889 | 6/2000 |
| JP | 2000-216047 | 8/2000 |
| JP | 2000-327964 | 11/2000 |
| JP | 2000-331534 | 11/2000 |
| WO | 01/00415 | 1/2001 |

* cited by examiner

INK JET DEVICE, INK JET INK, AND METHOD OF MANUFACTURING ELECTRONIC COMPONENT USING THE DEVICE AND THE INK

TECHNICAL FIELD

The present invention relates to a method of manufacturing ceramic electronic components such as laminated ceramic capacitors, high-frequency electronic components, filters, and multilayer substrates. The method uses an ink jet apparatus, which jets ink in a reliable manner to form the foregoing electronic components without contact between this printing device and these objects to be printed.

BACKGROUND ART

Conventionally, an internal electrode and a ceramic layer used for ceramic electronic components have mainly been manufactured by printing methods using printing plates, such as screen printing and gravure printing. These printing methods are suitable for mass-production; however, they are not good at producing small batches of a variety of products as a trend in recent years. Responding to such demands, ink jet printing for manufacturing ceramic electronic components has been suggested as a new printing method.

First of all, ink typically used for ink jet printing will be described. Typical ink for ink jet printing falls into dye- or pigment-types that volatilize or deteriorate by baking. Therefore, they cannot be used as electrode material, dielectric material, or magnetic material. For example, U.S. Pat. No. 3,889,270 suggests ink for ink jet printing on paper and U.S. Pat. No. 4,150,997 suggests aqueous fluorescent ink for ink jet printing and its manufacturing method; both inks cannot be applied to production of electronic components because they are used for coloring. Similarly, U.S. Pat. No. 4,894,092 introduces a heat-resistant pigment; this is also for coloring, so that it cannot be employed for electronic components. U.S. Pat. No. 4,959,247 introduces electrochromic coating and a method for making the same; this cannot be applied to production of electronic components. U.S. Pat. No. 5,034,244 introduces a method of forming a heat-resistant substrate pattern for glass using an inorganic ceramic pigment; such a pigment-type ink cannot lend itself to production of electronic components.

Next will be described ink for ink jet printing that is used for coloring ceramic substrates. U.S. Pat. No. 5,273,575 suggests ink for ink jet printing that can be used for coloring, for example, in black, green, and brilliant blue, ceramic substrates. The ink is, instead of pigments, made of a solvent in which some kinds of metallic salt are dissolved. U.S. Pat. No. 5,407,474 suggests another ink for ink jet printing used for coloring ceramic substrates, in which inorganic pigment has a limited particle diameter. U.S. Pat. No. 5,714,236 suggests yet another ink for ink jet printing for coloring ceramic substrates. In this patent, the ink is made by combining some kinds of metallic salt with flammable materials that serve as an oxygen supplier. Although the inks introduced in these suggestions are capable of printing and coloring such as marking electronic components made of ceramic, they cannot be used for an internal electrode, dielectric material, and magnetic material. On the other hand, Japanese Patent Examined Publication No. H5-77474 and Japanese Patent Non-examined Publication No. S63-283981 suggest methods of decorating a ceramic substrate employing chelate with application of heat. As another example, Japanese Patent Examined Publication No. H6-21255 suggests marking ink with application of heat, which is made of silicon resin and an inorganic coloring pigment, and a solvent. As yet another example, Japanese Patent Non-examined Publication No. H5-202326 suggests ink for marking ceramic substrates in which a soluble metallic salt is employed. As still another example, Japanese Patent Non-examined Publication No. H5-262583 introduces a marking method. This method suggests that an acidic aqueous solution in which a soluble metallic salt is dissolved should be applied to a ceramic substrate, and on which an alkaline aqueous solution should be applied for neutralization of metallic salt, and then the substrate should be baked. As another example, Japanese Patent Non-examined Publication No. H7-330473 introduces a marking method. This method suggests that ink, which is made of a metallic ion aqueous solution, is jetted onto a given shape of a ceramic substrate prior to baking. As still another example, Japanese Patent Non-examined Publication No. H8-127747 suggests marking ink for coloring ceramic substrates, which contains metallic pigments therein. However, all these inks for coloring ceramics are not suitable for production of electronic components.

Now will be described examples in which an etching resist used for production of electronic components is produced by ink jetting. U.S. Pat. No. 5,567,328 suggests that ink jet printing should be employed for producing a resist pattern of an etching resist in manufacturing a circuit board. Similarly, Japanese Patent Non-examined Publication No. S60-175050 suggests that ink jet printing should be employed for producing a three-dimensional resist pattern of an etching resist on a metal-coated substrate. Employing an etching resist, however, increases a cost of manufacturing electronic components. Conventional methods of ink jet printing and inks for ink jet printing, as described above, have not achieved a low-cost-production of electronic components.

Here will be described suggestions in which ink jet printing should be employed for manufacturing a variety of electronic components. Conventionally, some attempts had been made to manufacture electronic components by using an ink jet apparatus. For example, Japanese Patent Non-examined Publication No. S58-50795 suggests a method in which a conductor or a resistor is formed on an unbaked ceramic substrate by ink jet printing. According to conventional ink jet printing, as described above, in a process of forming an electronic circuit on a substrate, the ink for forming the electronic circuit tends to flow or extend out of an intended pattern on the substrate.

Referring to FIG. 14, here will be described an ink jet apparatus used for forming electronic circuits, which is suggested in Japanese Patent Non-examined Publication No. S58-50795. FIG. 14 illustrates a problem that tends to occur in forming electronic circuits by ink jet printing. In FIG. 14, being set in ink jet nozzle 2, ink 1 for forming electronic components is jetted by pressure from air and a piezoelectric element (both are not shown) on a "drops-on-demand" basis to form droplets 3. Landed onto substrate 4, on which a circuit pattern is to be printed, droplets 3 form pattern 5 in a predetermined shape. In this process, if ink 1 has aggregates 6 therein, it can cause unstable jetting of droplets from the ink jet nozzle, which sometimes results in a failure to print. That is, pattern 5 has faulty sections 7, such as a pin hole, due to aggregates 6. The ink 1 for forming electronic components, as described above, tends to have aggregates 6 therein that often clog ink jet nozzle 2. This problem has lowered yields of electronic components.

Referring to FIG. 15, here will be described forming precipitates or aggregates developed in ink for forming electronic components. FIG. 15 shows a result derived from calculation in which behavior of a powder in a solution is substituted into theoretical expressions. In the graph of FIG. 15, the Y-axis represents velocity (cm/sec) of a powder, and the X-axis represents a particle diameter (μm) of the powder. Line 8 shows velocity of the powder derived from the formula of the Brownian movement. It is apparent that the smaller the particle diameter of the powder, the greater the velocity of the powder (i.e., the Brownian movement of the powder becomes more remarkable.) Line 9 in the graph indicates velocity of the powder derived from the Einstein-Stalks's formula. This velocity is equivalent to a sedimentation velocity of the powder in a solution. That is, the larger the particle diameter of the powder, the greater the sedimentation velocity of the powder. Point 10 is an intersection of line 8, indicating the velocity of the powder in the Brownian movement, and line 9, indicating the sedimentation velocity of the powder. In a calculation result shown in FIG. 15, the solution has a viscosity of 1 cP (mPa s). Theoretically, in area α—the left-hand portion from point 10 as viewed in FIG. 15, due to a small particle diameter, the powder is subjected to the Brownian movement (represented by line 8) larger than the sedimentation velocity (represented by line 9). That is, the powder in area α is hard to sedimentate. On the other hand, the powder in area β—the right-hand portion from point 10—is subjected to a sedimentation velocity larger than the Brownian movement, so that this powder is easy to sedimentate. Point 10 is susceptible to a specific gravity of a powder, so that a position of point 10 moves to area α, i.e., leftward as viewed in FIG. 15, as the specific gravity of the powder increases. The graph theoretically tells that any ink being within the cross-hatching area in FIG. 15, that is, the area in which line 8 representing the Brownian movement exceeds line 9 representing the sedimentation velocity, is hard to have precipitation. Therefore, such ink could be handled with an ink jet apparatus available in the market, and can be commonly used aqueous dye-type ink.

The result shown in the FIG. 15, however, is derived from a theory in an "extremely diluted" condition; practically, consideration should be given to a relationship between powders in the solution. Therefore, the ink, even if it belongs to the aforementioned area in FIG. 15, may not be handled with an ink jet apparatus available in the market. That is, ink for electronic components employing the powder, being within the cross-hatching area and therefore theoretically not having precipitation, often forms precipitates or aggregates due to a variety of factors: incomplete dispersion; aggregates from a relationship between the powders; variations in particle size distribution; and heterogeneous precipitation—a theory explaining that mixture of powders having different particle sizes easily leads to aggregation. If the ink for electronic components can be consistently manufactured to have its powder particle diameter of 0.01 μm, the ink might have precipitation less than that belonging to the cross-hatching area in FIG. 15.

Now suppose that metallic powder or ceramic powder having an average particle size of 0.01 μm is selected from those available in the market. In actuality, however, it is impossible to completely eliminate a powder having a particle size of 1 μm even after high classification. Besides, a powder tends to have aggregates (or secondary particles) therein as the particle size of the powder becomes smaller. This fact sometimes allows a powder to have secondary particles larger than 1 μm, in spite of its primary particles having an average particle size of 0.01 μm. Furthermore, it is difficult to break such a secondary particle into a smaller particle even being well dispersed, thereby inviting an increase in a processing cost for practical use. In reality, ink for electronic components having powder with a particle diameter of at least 1 μm, or particularly around 10 μm, is preferably used in terms of obtaining an intended property and low-cost product. In this case, as is apparent from FIG. 15, sedimentation velocity indicated by line 9 exceeds the Brownian movement indicated by line 8 by several digits. In addition, a powder suitable for the ink for electronic components is a ceramic powder with its specific gravity of around 3 to 7, or is a metallic material with its specific gravity of approximately 6 to 20. Taking this into account, it is almost impossible, even in theory, to have stable dispersion in a solution having a low viscosity. In some cases, ink has a powder as a mixture of powders having different particle diameters to pursue an intended property. Such ink tends to have heterogeneous aggregation, so that it is difficult to obtain a stable dispersion. Besides, a fine particle having a submicronic diameter has a large amount of oil absorption—defined in Japanese Industrial Standards (JIS)—due to its large specific surface area, and accordingly, an amount of a solvent absorbed in a surface of the powder increases. Therefore, high concentration of powders in a solvent suddenly raises a viscosity of the solvent, thereby depriving fluidity from the solvent. In general, ink for printing on paper is mainly formed of a dye. Even in a case that pigments are employed, a concentration of the powder is maintained to be not more than 5 weight %. Whereas, in a case of ink used for producing electronic components, ceramic or metallic powder materials are required because an intended property cannot be obtained from dyes or metallic salts. In addition, the ink sometimes needs such materials having a concentration of the powder of several tens weight %, thereby inviting aggregation. For this reason, it has been difficult to realize consistent printing quality.

Referring now to FIGS. 16A and 16B, problems in a case of printing by a conventional ink jet apparatus having ink for electronic components will be described. In FIG. 16A, ink tank 11 is filled with ink 12 containing powder 13. Ink 12 has aggregates 14 developed from powder 13. Ink 12 in ink tank 11 flows, together with powder 13 and aggregates 14, into an interior of printer head 16 via piping 15. In response to an external signal (not shown), ink 12 stored in printer head 16 is jetted out on a drop-on-demand basis to form droplets 17. Droplets 17 land on a surface of substrate 18 to be printed, thereby forming ink pattern 19. Arrow 20 indicates a direction of flow of ink 12 in piping 15, or a direction of flying of droplets 17 jetted from printer head 16. FIG. 16B illustrates in detail a structure of piping 15 and printer head 16 shown in FIG. 16A, with the interior of head 16 enlarged. Aggregates 14 in FIG. 16B, which are developed from the powder in ink tank 12, piping 15, or printer head 16, lowers stability during printing.

In a conventional ink jet apparatus, aggregates 14 in ink 12 accumulate in the interior of printer head 16. The greater the time required for printing or the greater the volume of printing, the greater the amount of the aggregates. Therefore, it has been difficult for the conventional apparatus to provide stable printing for long hours.

Conventional jet ink for electronic components, as described above, tends to have aggregates or precipitates therein. These aggregates and precipitates not only clog a head of an ink jet printer, but also invite unstable ink jetting and cause ill effect on a direction of ink jetting. During ink jet printing, the printer head has no contact with a surface to be printed. If the direction of jetting ink does not conform to a predetermined direction, faulty patterns—a deformed pattern, pin hole in solidly shaded areas in printing, or a short circuit in a wiring pattern—may result.

Ink 1 for electronic components set in the interior of ink jet nozzle 2, as described above, forms precipitates 14 or aggregates 14, thereby inviting various adverse effects on an ink jetting condition; clogging spout 55, non-uniform spouting of droplets 3 jetted from spout 55, inconsistent amount of spouting with passage of time, or spout 55 clogged up with precipitates 14 or aggregates 14.

Although the precipitates and the aggregates are the same, this specification differentiates, for convenience's sake, between precipitation and aggregation in such a way that one precipitated at a bottom is referred to as a precipitate, while one floating in the ink is referred to as a aggregate. The ink required for producing electronic components, as described above, tends to have precipitates and aggregates, which has been an obstacle to stabilized quality in conventional ink jet printing. Precipitates 14 and aggregates 14 can not only clog the printer head, but also invite unstable ink jetting and cause ill effect on the direction of ink jetting. In the ink jet printing, the printer head has no contact with a surface to be printed. Therefore, if a direction of spouting ink does not conform to a predetermined direction, faulty patterns—a deformed pattern, pin hole in solidly shaded areas in printing, or a short circuit in a wiring pattern—may result.

Other than the examples introduced above, there are suggestions about methods of manufacturing electronic components by ink jet printing. For example, Japanese Patent Non-examined Publication No. H8-222475 suggests a method of manufacturing thick film electronic components using an ink jet apparatus. According to this suggestion, ink suitable for the thick film, such as an electrically conductive ink and an ink for a resistance film, is applied to an internal electrode pattern having a given shape on a surface of a ceramic green sheet, and the sheet is laminated and then baked. As another example, Japanese Patent Non-examined Publication No. S59-82793 has a suggestion in which an electrically conductive adhesive or a low-temperature baking conductive paste is applied, by ink jetting, to a predetermined connecting position on a printed circuit board. As still another example, Japanese Patent Non-examined Publication No. S56-94719 discloses a method of manufacturing a reversed pattern of an internal electrode by spraying ceramic ink, which eliminates unevenness, of a surface due to thickness of internal electrodes, from a laminated ceramic capacitor. Addressing the same problem, Japanese Patent Non-examined Publication No. H9-219339 has a suggestion in which ceramic ink is applied to a surface of a ceramic green sheet by ink jet printing. However, up to now, an ink jet apparatus and ink available for such suggestions have not yet come into existence.

As a similar example, Japanese Patent Non-examined Publication No. H9-232174 suggests a method of manufacturing electronic components including a laminated inductor. In a manufacturing process, functional material paste, such as electrically conductive paste and resistance paste, is jetted out, together with ceramic paste, by an ink jet system. As a method similar to the aforementioned one in which a laminated inductor is produced without using a via hole, U.S. Pat. No. 4,322,698 introduces a method of manufacturing a laminated inductor by alternately forming layers of insulating material so as to expose a part of each coil pattern. Japanese Patent Non-examined Publication No. S48-81057 suggests a method of laminating a coil through a via hole formed in a ceramic green sheet. Further, Japanese Patent Non-examined Publication No. H2-65112 has a suggestion about improving characteristics of a semiconductive capacitor in terms of its manufacturing process. In the process, a required amount of dorpant solution is ink jetted, as a form of droplets, onto a surface of a device of a semiconductive capacitor. In this case, to prepare ink for ink jetting, metal ionic salts are dissolved in ethyl alcohol or acid for pH-control. When materials for forming electronic components are dissolved in the ink, as is the case above, neither precipitates 14 nor aggregates 14 shown in FIGS. 16A and 16B are developed in the ink. Still, the aforementioned method cannot provide electronic components as a method suggested in the present invention.

There are some suggestions about coloring a surface of ceramics or forming a predetermined image on the surface, and not forming an electronic circuit thereon. As ink for ink jet printing, a metallic ion solution is employed in Japanese Patent Non-examined Publication No. H7-330473; an organometal chelate compound is employed in Japanese Patent Non-examined Publication No. S63-283981; water glass is added to ink in Japanese Patent Examined Publication No. H5-69145; and silicon resin is added in Japanese Patent Examined Publication No. H6-21255. These forgoing suggestions are, however, aimed at forming images, not electronic circuits. Therefore, they are no help for manufacturing electronic components.

In methods of manufacturing a variety of electronic components by conventional ink jet printing, a nozzle of a printer head requires jetting ink containing powdery material that is necessary for manufacturing electronic components, such as ceramics, glass, and metal. Such powders contained in the ink have often clogged the nozzle, as described in FIGS. 14 through 16B. For this reason, almost no demonstrations in which electronic components can be manufactured by ink jet printing has been made. In particular, in a case of manufacturing a variety of electronic components, ink for ink jet printing is required to have a property suitable for each component to be manufactured. Supposing manufacturing of laminated ceramic electronic components; an ink for an internal electrode needs to contain palladium, nickel, silver palladium; an ink for a dielectric material needs dielectric material; and an ink for an external electrode needs silver.

Furthermore, a coil part needs ink for magnetic material, and a coil conductor needs ink containing silver or copper. When a chip resistor is manufactured by ink jet printing, it becomes necessary to prepare a plastic ink for ink jetting, an insulating glass-made ink, an ink for over-coating, an ink for graphic printing, a graze ink, an ink for an electrode, an ink for a resistor, and ink for an external electrode. Only for the ink for a resistor, should be prepared dozens of types of different inks that have resistance ranging from a few mΩ up to several tens of MΩ, with a temperature coefficient of resistance (TCR) adjusted within a predetermined range. The inks for ink jet printing that meet such diverse requirements neither have been commercially available, nor reported in a learned society or the like. Even if prototypes of these inks are built and tested, clogging a nozzle may result due to the problems explained in FIGS. 16A and 16B.

As for ink for printing on paper—not for manufacturing electronic components, many suggestions have been made to address the problems above. As an example of these attempts, Japanese Patent Non-examined Publication No. H5-229140 introduces a suggestion in which ink containing inorganic pigments is stirred in an ink-supplying chamber and then fed to a head of an ink jet printer.

As another example, Patent Non-examined Publication No. H5-263028 suggests that ink should be filtered by a metallic filter with application of pressure. To filter ink for manufacturing electronic components, an extremely fine filter is required. However, such a fine filter for electronic components is not available at a time of the present invention. The inventors added a treatment, as an experiment, to various types of ink commercially available for manufacturing electronic components using screen-printing. The inventors decreased a viscosity of the inks by dilution; then filtered them by a metallic filter to print them by a commercially available ink jet printer. However, metal powder and ceramic powder included in the ink immediately precipitated, thereby resulting in failure. To avoid forming precipitates, the inventors fed the ink, with application of stirring, to the printer head. This attempt invited clogging of the printer head caused by particles of the ink precipitated in the printer head. As is proved by this attempt, an ink jet apparatus capable of coping with ink having high-concentration, high-density, and low-viscosity that is typified by ink for electronic components to offer reliable printing, has not yet been on the market.

Next will be described inconveniences in printing an electrode onto a ceramic green sheet with a thickness of at most 20 μm. The inventors demonstrated that a solvent of ink penetrates into a ceramic green sheet and causes a short circuit, thereby decreasing a yield of a product. This problem and its measure are disclosed in Japanese Patent No. 2,636,306 and Japanese Patent No. 2,688,644. That is, in a case of employing a ceramic green sheet with a thickness of less than 20 μm, penetration of a solvent of ink through such a thin sheet can cause a short circuit, even if electrodes can be formed by ink jet printing.

Inks employing dye and a metallic salt have been conventionally suggested; however, no suggestion has been made about an ink jet apparatus that can offer reliable printing using ink easily forming precipitates and aggregates, such as ink for manufacturing electronic components. Even if such inks for electronic components as a completed product are filtered by an extremely fine filter, precipitation or aggregates in the ink jet apparatus may result. This fact easily invites clogging of a printer head or ink-spouting section, and as a result, it has been difficult to obtain printing with stability. Of the ink for manufacturing electronic components, the ink employing dye or metal salt can offer relatively good printing. Such inks, however, are intended for coloring, not for manufacturing electronic components such as LC filters and high-frequency electronic components. Besides, in a process of producing laminated ceramic electronic components, and in a case that ink for electrodes is applied onto a thin ceramic green sheet with a thickness of less than 20 μm, a conventional ink jet apparatus has not been successful in providing printing quality with stability. Such inks, due to their property of easily forming precipitates and aggregates, tend to clog the head or the ink-spouting section of an ink jet printer, thereby resulting in inconsistent printing. An effective suggestion to solve the above problems has not yet been made.

SUMMARY OF THE INVENTION

The present invention provides an ink jet apparatus equipped with an ink-circulating/dispersing system, offering ink jet printing with stability. The system circulates ink and disperses it as required, thereby protecting the ink from forming precipitates and aggregates. During circulation, on the way to an ink-collecting tank via a tube, a portion of the ink containing powder is fed to a printer head and jetted onto a surface of a substrate to form a predetermined pattern. With this structure, the apparatus can cope well with ink having poor stability in terms of printing due to its easy-to-precipitate property, thereby offering ink jet printing with consistent quality onto a ceramic green sheet.

DETAILED DESCRIPTION OF THE PREFERRED EMBODIMENTS

First Embodiment

Figure 1A:
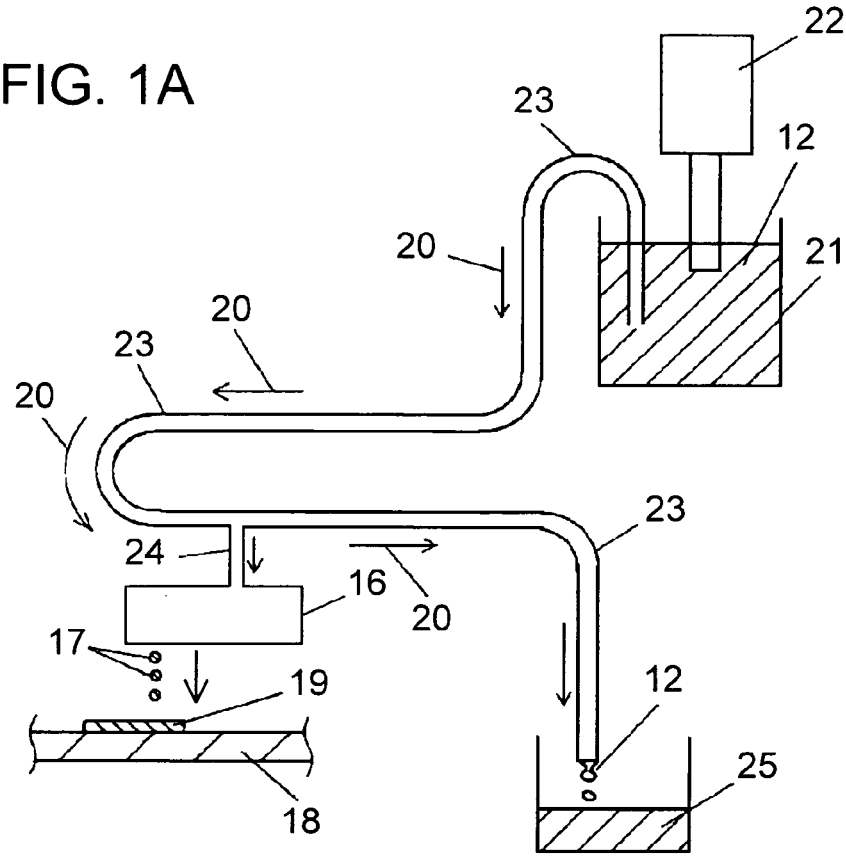
FIG. 1A illustrates an ink jet apparatus of an embodiment of the present invention.

An ink jet apparatus and its ink-supplying system of a first embodiment of the present invention will be described, with reference to FIG. 1A. An interior of ink tank 21 of FIG. 1A is filled with ink 12. Dispersing unit 22 disperses ink 12 in ink tank 21 as required. The ink stored in tank 21 flows by its own weight via first tube 23 into ink collecting tank 25. Setting ink tank 21 to a position higher than that of ink-collecting tank 25 can provide the ink with natural flow, on a principle of a siphon, without using a pump or the like. Through the process above, ink 12 in tank 21 flows through first tube 23 and drips down into tank 25. According to the present invention, ink 12 has constant flow through first tube 23 and some of the ink to be used for printing is carried through second tube 24 to printer head 16. Printer head 16 filled with ink 12 jets out the ink on a "drops-on-demand" basis in response to an external signal (not shown) to form droplets 17. Droplets 17 land on a surface of substrate 18 to be printed to form ink pattern 19. Arrows 20 in FIGS. 1A and 1B indicate a flowing direction of ink 12 in first tube 23 and second tube 24, and also indicates a flying direction of droplets 17 jetted from printer head 16.

Employing a flexible tube—for example, a plastic tube—for first tube 23 and second tube 24 allows the ink jet apparatus to be easily fixed to a commercially available printer; the apparatus can be fixed to a printer in price ranges of several ten thousands yen, which is used for printing, for example, New Year's cards or images taken by a digital camera, with no need for modifying the printer itself. According to this embodiment, as described in FIG. 1A, constant flow of the ink protects powders contained in the ink from precipitation. However, a conventional ink jet apparatus shown in FIG. 16 has low consumption of ink (which indicates an amount of the ink jetted from the printer head). That is, the ink at least being in the tubes is in almost stationary state, whereby the powder in the ink is easily formed into aggregates.

Figure 2:
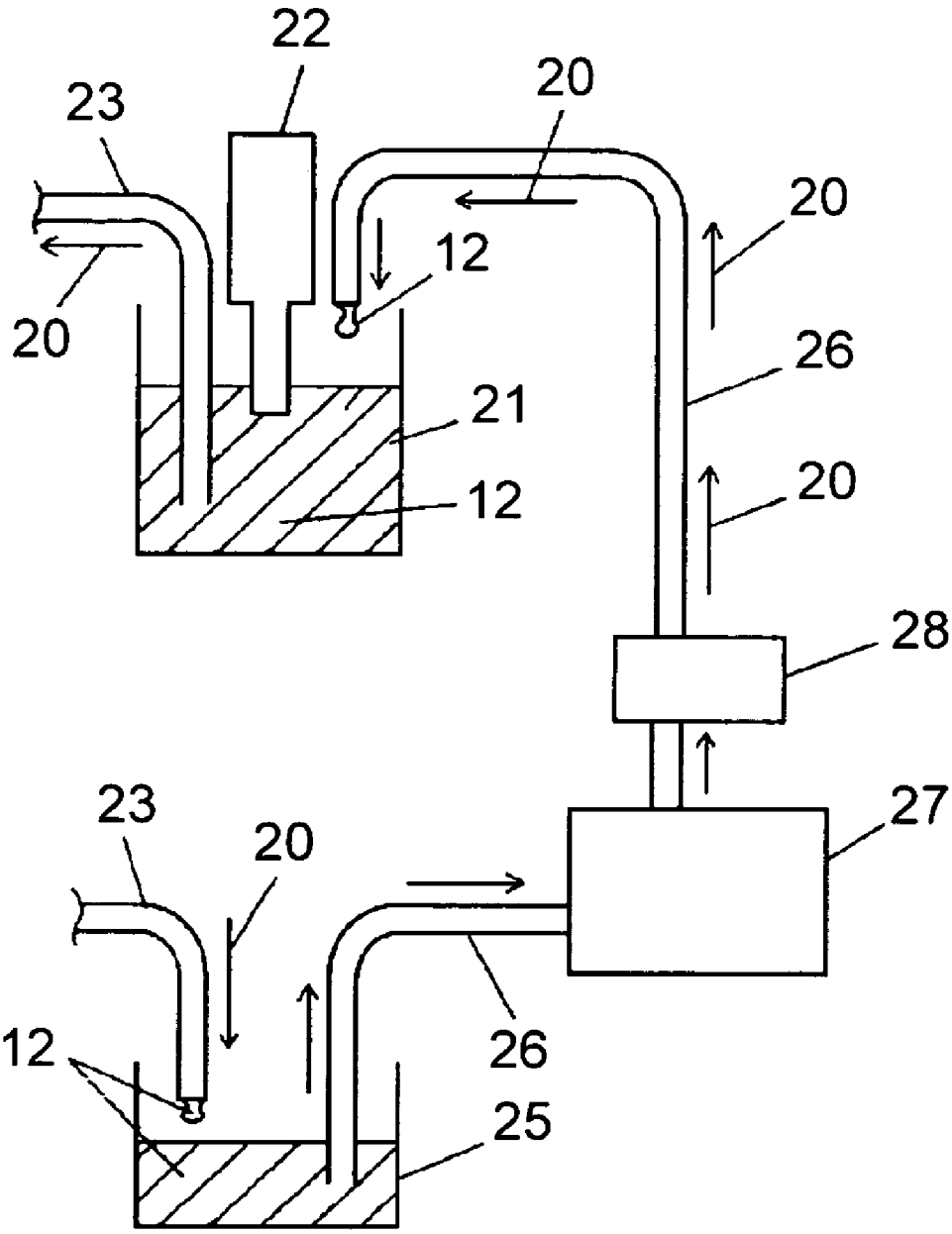
FIG. 2 illustrates an ink-collecting/recycling mechanism of an embodiment of the present invention.

Next will be described an ink-collecting/recycling mechanism of the ink jet apparatus of an embodiment of the present invention, referring to FIG. 2. FIG. 2 illustrates the aforementioned mechanism. In FIG. 2, ink 12 collected into ink-collecting tank 25 is sucked into pump 27 via third tube 26, and then via ink-recycling unit 28, ink 12 finally drops down into ink tank 21. According to the present invention, ink recycling unit 28 filters out aggregates contained in the ink using a filter, thereby optimizing solids and viscosity of the ink and removing gas from the ink. Through the process described above, combination of the ink-supplying mechanism shown in FIG. 1A and the ink-collecting/recycling mechanism shown in FIG. 2 allows easy-to-aggregate ink for electronic components to have stable printing for long hours, thereby manufacturing various electronic components with higher yields and lower cost.

A more detailed explanation will be given hereinafter. In this embodiment, an ink jet printer commercially available within a price range of several ten thousands yen is used; for example, the printers manufactured by EPSON Inc., Canon Inc., Nippon Hewlett-Packard Co. The inventors removed a factory-shipped ink cartridge from the printer, and instead, attached the ink-circulating unit shown in FIG. 1A. For the tube of the ink-circulating unit, a transparent flexible plastic tube with an inner diameter of 3 mm (outer diameter of 5 mm) is employed, which is available in the market.

As for ink, the ink for manufacturing electronic components used in ink jet printing—the one suggested by the inventors in Japanese Patent Non-examined Publication: No. H12-182889, H12-327964 and No. H2000-331534—is employed. The ink is filtered by a 5 μm membrane filter (surface filter) to obtain ink 12 of the present invention. Ink 12 is stored into ink tank 21 that is made of a 250 ml polyethylene bottle available in the market. In this way, the inventors combined the ink-circulating unit shown in FIG. 1 with the ink-collecting/recycling unit shown in FIG. 2. In the experiment, ink-collecting tank 25 (made of a 500 ml polyethylene bottle) was directly placed on an experiment table—that is, tank 25 was placed at a height of 0 cm from the table. As a next step, the printer was set on a height-adjustable workbench. With a jack, the inventors adjusted a height of the workbench so that a position of printer head 16 maintains a height of 9 cm from the table. Similarly, ink tank 21 was set on another height-adjustable workbench and a height of the workbench was adjusted with a jack so that a surface of the ink in tank 21 maintains a height of 25 cm from the surface of the table. Through the adjustment, these three components were set up in such a way that ink tank 21 has the highest position, the printer head comes under the tank, and the ink-collecting tank comes in the lowest. First tube 23 was set such that one end of the tube is immersed in the ink in ink tank 21. Next, with a commercially available aspirator, the inventors allow the aspirator to draw ink 12 from another end of first tube 23 (on the side of the ink-collecting tank), thereby filling the interior of tube 23 with ink 12; prior to aspiration, second tube 24 was pinched with fingers so that air cannot come in through printer head 16. When first tube 23 was filled with ink 12, ink 12 stored in ink tank 21 started to drip down by its own weight, via first tube 23, into ink-collecting tank 25.

Next, the inventors pushed a cleaning switch on the printer several times to draw ink 12 into the interior of the second tube 24; before the drawing, the interior of the tube is not filled with ink 12 but with air. In this way, ink 12 in tank 21 started to constantly drip down into ink-collecting tank 25. Ink 12 collected in the collecting tank 25 was returned to ink tank 21 by pump 27. As for pump 27, a tube pump was employed—using a tube pump allows ink to move with a constant flow back to the ink tank without priming, even if the ink-collecting tank is empty (i.e., not filled with ink). As for an ink-recycling unit, a filter available in the market is used. Preferably used is a volume filter such as the Wattman's glass filter. A volume filter is hard to be clogged, and therefore can stand long-duration use. Whereas, using a surface filter typified by a membrane filter easily causes clogging, which can develop ink-leakage at a joint of ink-recycling unit 28 and third tube 26, or at pump 27. Sometimes ink sprayed out from this leakage-occurred section splashes on surroundings. Therefore, the surface filter is not suitable for ink-recycling unit 28. Although the surface filter is easy to be clogged, a filtering performance itself is superior to that of the volume filter. Considering this, the surface filter can be effectively used in filtering the ink just before ink tank 21.

To connect first tube 23 with second tube 24, a commercially available plastic T-joint pipe could preferably be used; this makes it easy to adjust a length of the tubes, that is, makes it easy to adjust heights of ink tank 21 and printer head 16.

Figure 16A:
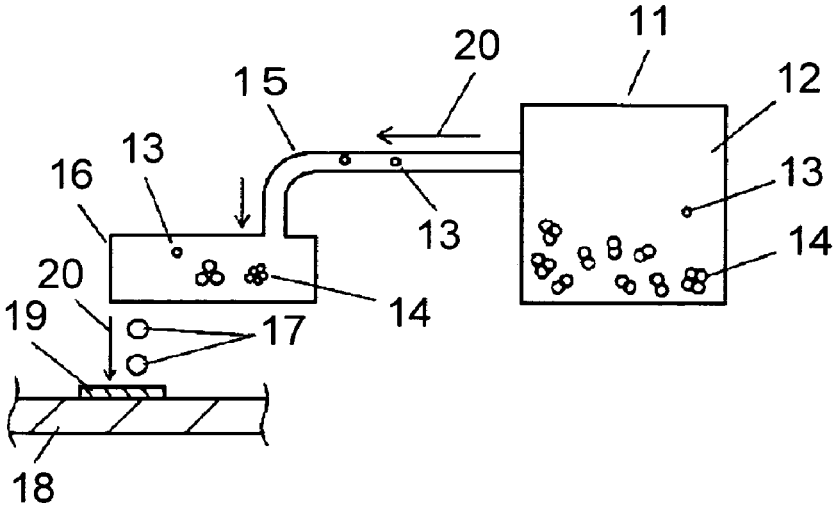
FIGS. 16A and 16B illustrate a problem occurring in printing, using ink for electronic components set in a conventional ink jet apparatus.

To compare the apparatus of the first embodiment with a conventional one, the inventors performed a continuous printing/intermission experiment using a conventional ink jet apparatus (shown in FIG. 16A). To begin with, as shown in FIG. 16A, continuous printing was performed on A4-size paper, with ink tank 11 connected to printer head 16 via pipe 15 (that is made of material the same as that of the aforementioned first tube). In the experiment, continuous printing of ten sheets and one hour intermission were alternately repeated several times. A first continuous printing of ten sheets was successfully performed; however, a second continuous printing of ten sheets after one hour intermission exhibited poor quality—a printed output was blurred. To perform cleaning, the inventors operated again the cleaning button on the printer. Printing quality was slightly improved by the cleaning; still, the quality was not worth being practically used.

To examine the interior of the printer head 16, the inventors removed the head from the printer. Inspection found that a bunch of aggregates 14 in ink 12—partly gelatinized aggregates—clogging the head degraded printing quality. As an experiment, the continuous printing/intermission experiment was performed using another new printer head. The result was the same as the first trial; the first continuous printing was performed well, however, the second printing after one hour intermission had blurred printed output. From results of the experiment, the inventors concluded that such an apparatus, incapable of printing after only one hour intermission, would not bear for practical use.

With the apparatus of the first embodiment of FIGS. 1 and 2, the same experiment was performed. Prior to the experiment, adjustments on the apparatus were provided as follows. Run ink stored in ink tank 21, as shown in FIG. 1A, by its own weight, via first tube 23, into ink-collecting tank 25; using pump 27, as shown in FIG. 2, move ink 12 collected in ink-collecting tank 25 back to tank 21 through ink-recycling unit 28, whereby ink 12 starts to circulate. A commercially available ultrasonic dispersing unit 11 (manufactured by Nippon Seiki Co. Ltd., 50 W-horn type) was fixed to ink tank 21. Dispersing by periodic ON/OFF operation with a timer prevented ink 12 from forming aggregates. When an ultrasonic dispersing unit is employed, it is preferable to periodically switch between ON and OFF. Constant ON operation can cause undesired rise in temperature of ink 12, or form a thin film on a surface of the ink due to dried air, thereby degrading printing stability. When the temperature of ink 12 varies, ink tank 21 should preferably be put in a thermostatic bath. This treatment protects ink 12, i.e., easy-to-aggregate ink for electronic components, from temperature rise during dispersing. The printing experiment, as was the case of the conventional apparatus, was performed on A4-size paper; ten sheets continuous printing and a one hour intermission were alternately repeated several times. The first ten sheets continuous printing was successfully performed. The second ten sheets continuous printing after one hour intermission also offered good quality with no problem. This is so because of the circulation shown in FIGS. 1A and 2, which provides ink 12 with a constant dispersion. In this way, a cycle of ten sheets continuous printing and one hour intermission was repeated 10 times. All of printing was successfully performed. As the next step, five intermission periods following the printing were varied: one hour, two hours, ten hours, twenty-four hours, and fourty-eight hours. In spite of long intermission, the apparatus was always ready for continuous printing and offered good printed output.

In the experiment, the dispersion and circulation of the ink shown in FIGS. 1A and 2 were given regardless of whether or not the printer was in operation. As an experiment, the inventors stopped to disperse/circulate the ink during the intermission. In the printing after the intermission, the printed output exhibited a blur, as is the case of the conventional apparatus. The experiment found that the ink jet apparatus of the present invention can cope well with the easy-to-aggregate ink for electronic components, offering a long-duration printing with stability.

As proved in the experiment, providing constant dispersion and circulation in ink tank 21 prevents ink, which is easy-to-aggregate in a standstill state, from forming aggregates. Even if the ink already has aggregates, the apparatus can decompose them, thereby offering ink jet printing with stability for long hours.

Figure 1B:
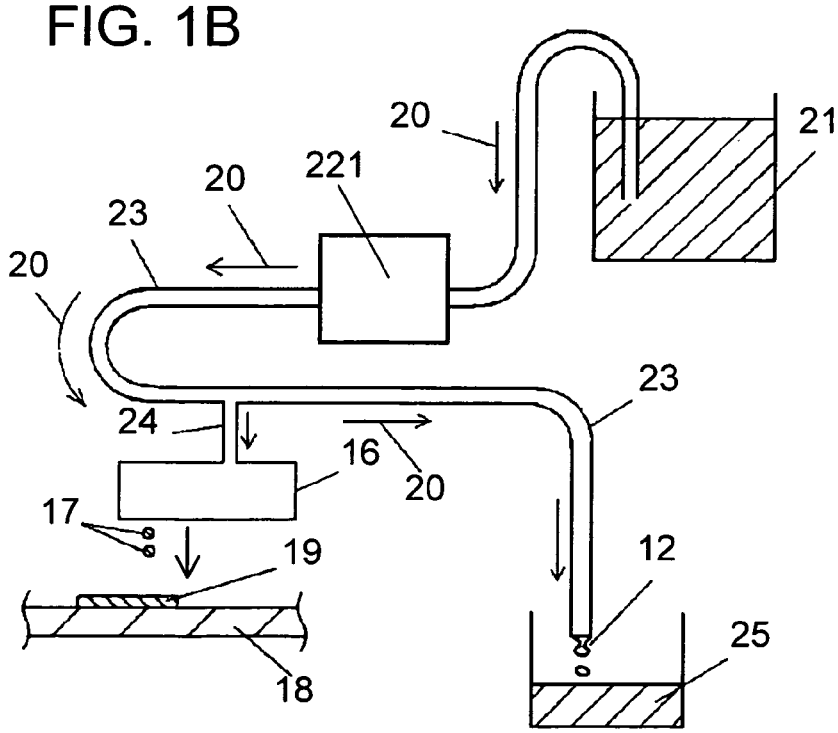
FIG. 1B illustrates an ink jet apparatus of an embodiment of the present invention.

Dispersion of the ink can be given in first tube 23 of FIG. 1B, instead of being performed in ink tank 21 of FIG. 1A. That is, putting a part of tube 23 into ultrasonic water tank 221 or an ultrasonic cleaner can ultrasonically disperse ink 12 while the ink flows in the direction indicated by arrow 20. When first tube 23 is made of plastic, ultrasound does not reach, due to attenuation, the interior of tube 23. This problem can be solved by forming a part of tube 23 of metallic material and putting this metallic part into ultrasonic water tank 221. According to the present invention, as is normal, feeding the ink through the first tube repeatedly disperses the ink, by which the ink becomes hard-to-aggregate.

The ink can be dispersed by stirring or circulation or the like. Besides, employing operation for dispersion together with ultrasound can remove air mixed into the ink, and uniformity of the ink is obtained. Whether or not the ink has uniformity can be also determined from following observations: presence or absence of precipitates in the ink in a standstill condition; differences in concentration, density, specific gravity, and color between a bottom and surface of a container storing the ink. To manufacture electronic components with excellent quality, concentration-difference between the bottom and the surface should be smaller than 5%. Concentration-difference greater than 10% can cause variations in characteristics in completed products. The apparatus of the present invention can disperse the ink in the ink tank and thereby concentration-difference of less than 5% in the ink tank is easily attained. In addition, since the ink constantly flows through the first tube, concentration-difference in the tube is controlled. Therefore, the apparatus of the present invention can maintain a concentration-difference of less than 5% in the conventional easy-to-precipitate ink—specifically, ink having concentration-difference and density-difference greater than 10%, when stored in a container in a standstill condition. The ink jet apparatus of the present invention can thus manufacture electronic components with excellent quality.

Second Embodiment

An example in which removing fine bubbles mixed into the ink further improves printing stability is explained. In a case that the ink jet apparatus having piezoelectric printer head 16 is employed, it is known that bubbles entered into the ink reside and grow in the printer to absorb vibration energy of piezoelectric elements and cause unstable printing (see P. 202–206 of "Ink jet printing technology and materials" compiled under the supervision of Takeshi Amari, professor at Chiba Univ., published from CMC Publishing Co. 1998). In particular, the present invention has a structure in which dispersing unit 22 is fixed to ink tank 21. A problem is that employing a high-speed rotating homogenizer or ultrasonic dispersing unit for dispersing unit 22 can entrain fine bubbles into ink tank 21. For example, in the case of using the high-speed rotating homogenizer, bubbles captured from a surface of the ink are often observed; similarly, in the case of the ultrasonic dispersing unit, fine bubbles possibly brought by cavitation are observed. The inventors experimentally proved that fine bubbles being approximately 0.1 mm in diameter often appear in the ink. Generally, fine bubbles with a diameter of approximately 0.1 mm, which can be barely observed through a magnifying glass, often appear in ink and, once they have appeared, they won't disappear unless a certain treatment is performed. Such fine bubbles cannot go up to the surface of the ink due to their small size and suspend in the ink. An experiment by the inventors proves that the fine bubbles suspending in ink 12 stored in ink tank 21, as described above, flows, via first tube 23 then second tube 24, finally into printer head 16, thereby sometimes inviting failure in printing. Considering this, transparent tubes are preferably used in the present invention; if a colored or opaque tube is used, it is hard to monitor the bubbles traveling through the tube.

Figure 3A:
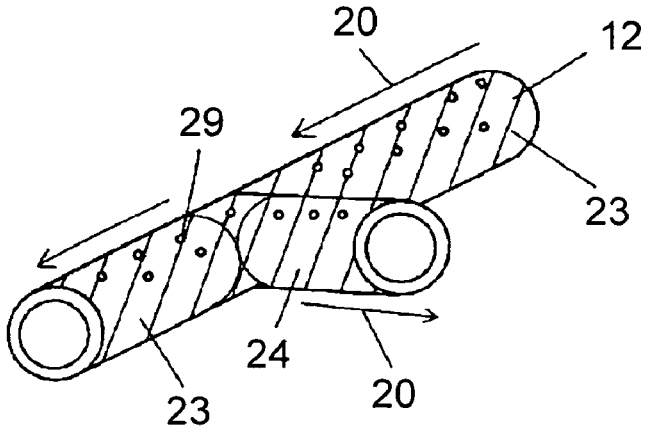
FIGS. 3A and 3B illustrate an example of removing extremely fine bubbles from ink of an embodiment of the present invention.

Now, how to remove the bubbles is explained referring to FIG. 3A through FIG. 5. FIG. 3A schematically shows the bubbles traveling through the tube. Ink 12 flows through first tube 23, as shown in FIG. 3A, in the direction indicated by arrow 20. Fine bubbles 29 in the ink travel with the flow of the ink due to their small size. An amount of fine bubbles 29 flows with ink 12 via second tube 24 into printer head 16 (not shown in FIGS. 3A, 3B), thereby degrading printing quality.

Figure 3B:
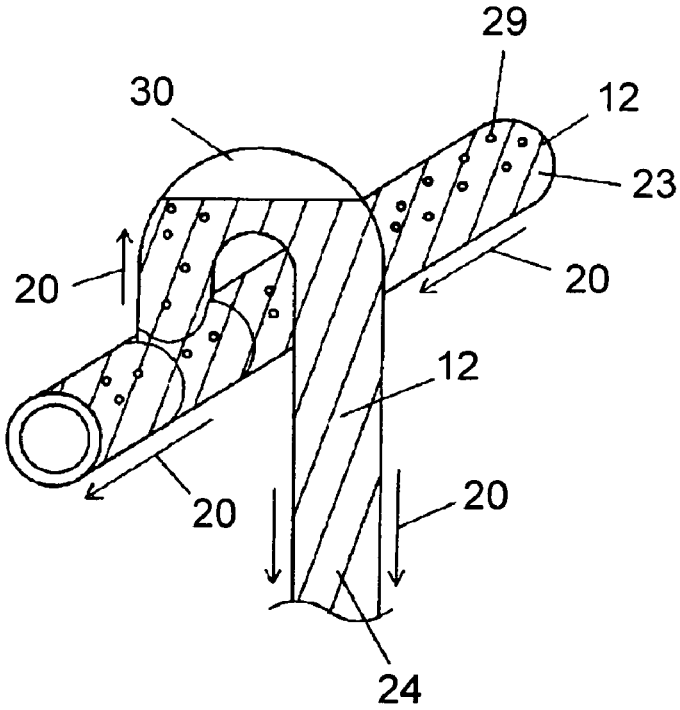

FIG. 3B shows an effective structure capable of removing the bubbles 29 shown in FIG. 3A. As shown in FIG. 3B, a reversed U-shape bending structure of second tube 24 removes the fine bubbles from the ink. According to the structure, fine bubbles 29 carried through first tube 23 are trapped into air trap 30 created at a bend of third tube 24; that is, the bubbles cannot intrude in the path toward printer head 16 (not shown in FIGS. 3A, 3B). Removing fine bubbles 29 on the way to the printer head, as described above, can provide printing with stability.

Figure 4A:
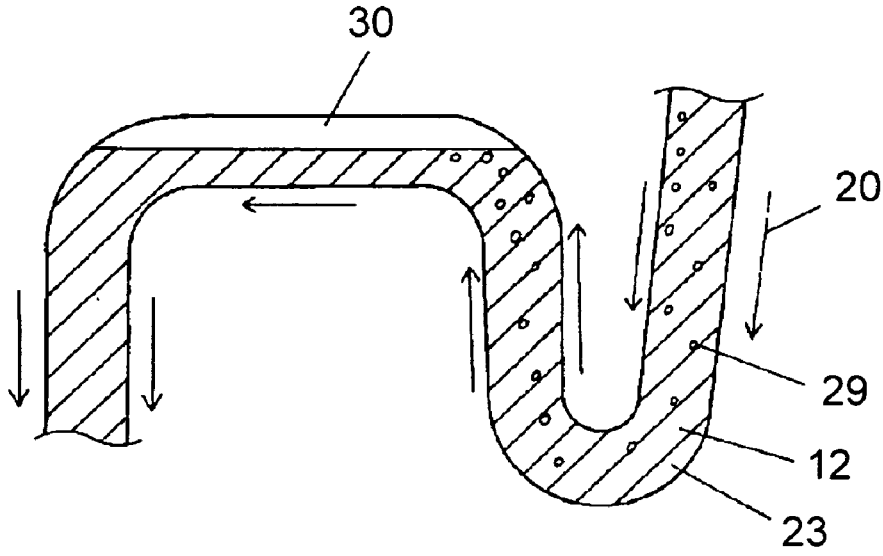
FIGS. 4A and 4B illustrate another example of removing extremely fine bubbles from ink of an embodiment of the present invention.
Figure 4B:
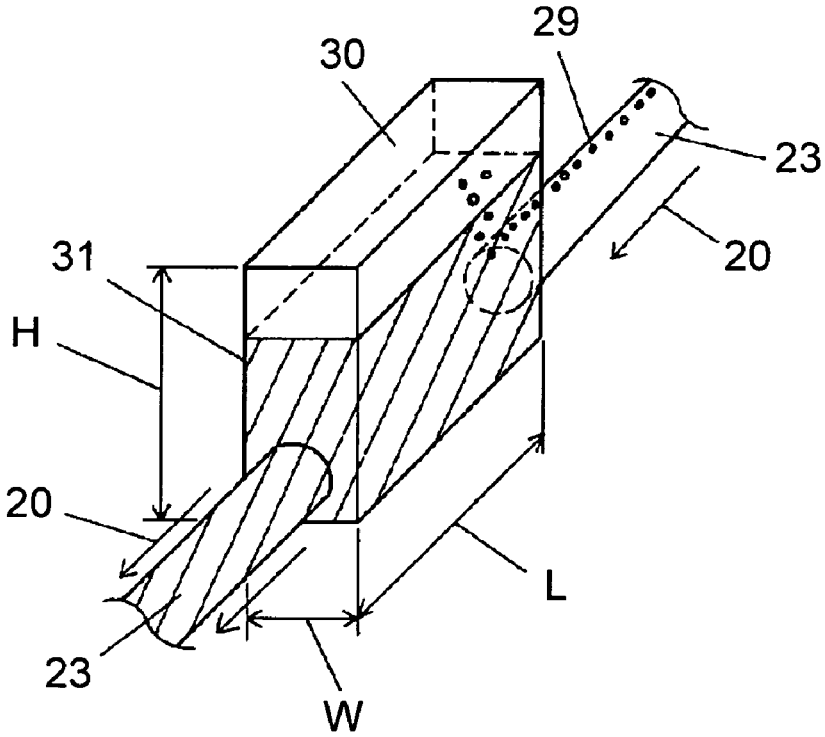
Figure 5:
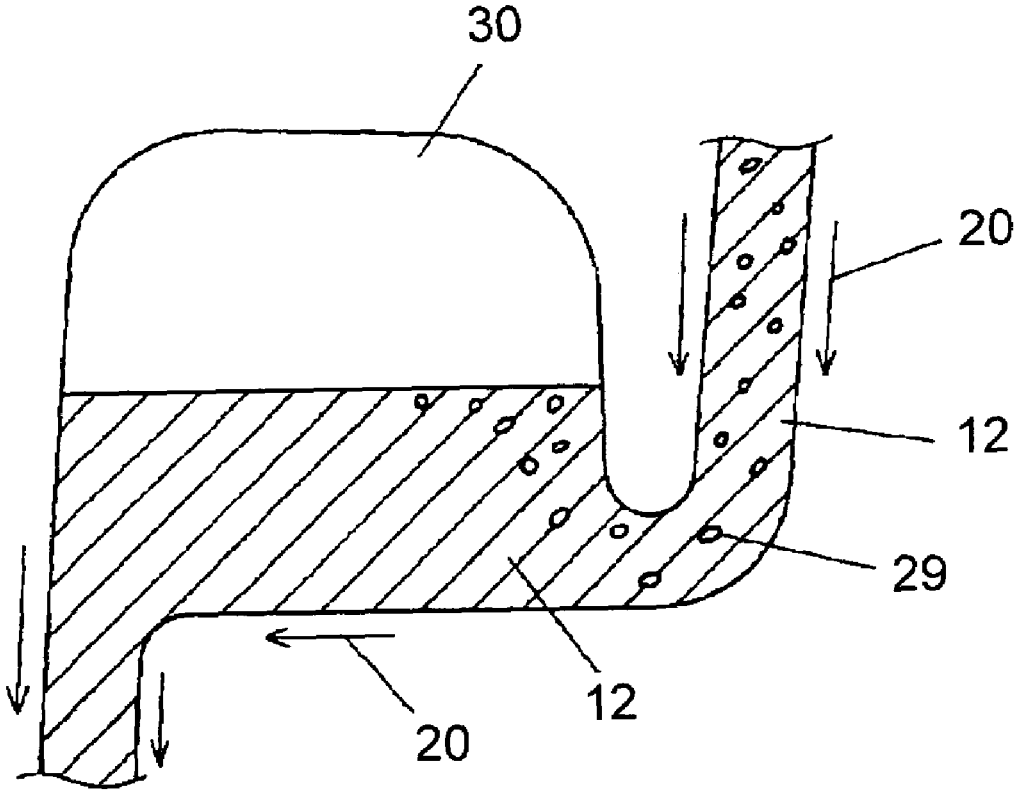
FIG. 5 illustrates yet another example of removing extremely fine bubbles from ink of an embodiment of the present invention.

FIGS. 4A through 5 give a more detailed explanation about effective removing of the fine bubbles contained in the ink. First tube 23, as shown in FIG. 4A, is bent into a reversed U-shape. Reversed U-shape structure of tube 23 easily traps fine bubbles 29 mixed in with ink 12. Fine bubbles 29 do not surface easily as described earlier. Considering this behavior, forming first tube 23 into a reversed U-shape with the bottom of "U" prolonged, as shown in FIG. 4A, is more effective in trapping fine bubbles 29. Air trap 30 in FIG. 4A is formed of trapped fine bubbles 29. FIG. 4B shows a case in which a dedicated bubble-trap unit is used instead of the tube 23 having the reversed U-shape. Inserting bubble-trap unit 31 into first tube 23, as shown in FIG. 4B, is further effective in removing fine bubbles 29 from the ink. As for dimensions—height (H), length (L), and width (W) of bubble-trap unit 31—an experiment by the inventors proved that a shape having a smaller width (W) has a noticeable effect on trapping bubbles. In particular, a shape having as small a width as possible is preferable; specifically, a width of less than 10 mm (preferably, less than 5 mm) is effective in trapping bubbles. In addition, a shape having a greater H, in contrast to smaller W, decreases the velocity of flow of ink 12, whereby fine bubbles 29 easily become trapped into air trap 30. It is preferable that bubble-trap unit 31 is made of plastic having transparency, such as acrylic resin. In an opaque plastic trap unit, since air trap 30 cannot be seen from the outside, the shape and size of bubble-trap unit 31 or the velocity of flow of ink is difficult to optimize. It is preferable that bubble-trap unit 31 has a surface (preferably, a side surface) made of transparent plastic film with some elasticity. Even if bubble-trap unit 31 is made of firm material, preferably, the unit should have one surface over which a soft film is attached. Employing such material allows the unit to serve as a pressure damper, coping well with changes in quantity of ink. This will contribute to stabilized printing. To be more specific, if internal pressure of bubble-trap unit 31 increases, the air collected in air trap 30 tends to dissolve in ink 12. However, employing elastic material for the side surface of the unit suppresses a rise in pressure in air trap 30 and prevents air from dissolving in the ink.

At first, using an opaque plastic tube—a urethane plastic black tube widely used for air piping or the like, the inventors pursued development of the ink jet apparatus shown in FIGS. 1A and 2. In the tube, however, fine bubbles with diameter of less than 5 mm easily appear when the ink is dispersed in the ink tank. Besides, the fine bubbles are flowed into the tube leading to the printer head because such bubbles are hard to float on a surface of the ink. The inventors depended on trial-and-error methods to achieve an effective bubble trapping. Bubble-trapping is sensitive to arrangement of pipes and tubes; a slight shift in positioning has often adversely affected bubble-trapping. However, using the Tygon tube (manufactured by Sangoban Norton Inc.) solved the problem; bubble-trapping was substantially perfect. It is possibly because of its transparency and a finely processed inner wall. The inventors could observe a slow but steady movement of fine bubbles, without attaching to the inner wall, in flow of the ink. Generally, ultrasonic dispersion easily generates fine bubbles with a diameter of approximately 0.1 to 0.5 mm. According to an observation by the inventors, if the tube has a smooth inner wall, the fine bubbles, which cluster in an upper area of the interior of the tube, are slowly moved by the flow of the ink. When the ink is drawn by first tube 23 from ink tank 21, as shown in FIG. 1A, bending first tube 23 into reversed U-shape at a brim of ink tank 21 can trap the fine bubbles into the upper area of the bend. Besides, considering the fact that the bubbles flow toward a higher location, lifting up a part of the first tube so as to form a reversed U-shape, or controlling the velocity of flow of the ink is effective in moving the bubbles in a desired direction, regardless of being opposite to the flow of the ink or in the direction thereof. In this way, the structure above successfully decreased the fine bubbles flowing into first tube 23 from ink tank 21.

Other than the Tygon tube, the inventors experimentally used other plastic tubes. These experiments found that a tube having properties below are preferable: having low gas permeability; having repellency to the ink, having a washable inner wall with water or a solvent to wash the ink away; having an inner wall that exhibits less trapping of powders in the ink, that is, having a smooth surface, high surface-tension, water/oil repellency. These properties keep the powders and bubbles away from the inner wall, i.e., to move along the inner wall. When the inner wall of the tube has perfect repellency to the ink, the powders or aggregates in the ink often happened to attach easily to the inner wall. Depositing of the powders on the inner wall during a long duration use can develop the aggregates. However, as long as the required properties described above are taken into account, a good choice will be easily selected from among several alternatives other than the Tygon tube. Similarly, a jig for connecting the tubes needs to be selected with particular care described above. Such attention prevents against undesired convection of the ink in the jig, thereby minimizing depositing of powders and bubbles on the inner wall.

Through experiments being repeatedly performed, the inventors could identify ink optimal for ink jet printing and a behavior of bubbles —fine bubbles flowed into first tube 23—also tend to gather in a upper area in the interior of the tube. Considering this behavior, employing transparent material for the joint of first tube 23 and second tube 24 shown in FIG. 1A, and further, attaching the second tube with a lower part (or the bottom) of the first tube, can block the bubbles in the first tube so as not to flow into the second tube. Furthermore, employing transparent plastics for first and second tubes 23, 24, and a joint section between them, allows the flow of bubbles to be optimized through a visual check. In addition, partially changing the thickness of first and second tubes 23, 24 can control the velocity of flow of ink in the tubes. A thickened part allows the bubbles not to be carried by the flow of the ink, whereby the bubbles can be easily controlled to move up along the inner wall of the tube; on the other hand, a thinned part locally increases the velocity of flow of the ink, thereby dispersing the ink in the tube. A degree of slant of the tubes is also important in controlling the bubbles; the greater inclination the setting of the tube has, the faster the bubbles flow. At least in a designing stage, transparent material should be employed for the tube and the connecting jig. Such selection will be a great help to optimize control of the ink according to a scale of the ink jet apparatus. The velocity of flow of the ink should preferably range from 0.1 mm per min. to 100 mm per sec.—a velocity of flow of less than 0.1 mm per min. can cause precipitation of the ink in the first tube 23; on the other hand, a velocity of flow more than 100 mm per sec. can cause inconsistencies in printed output due to high rise in pressure of the ink in the first tube 23.

It is preferable that the second tube 24 is connected with a bottom area, i.e., an area having no bubble-flow, of the first tube 23 so that bubbles cannot flow into the second tube 24. Such versatility of adjustment is a good point that only the ink jet apparatus of the present invention is capable of, it has been impossible in the prior-art. As for the first tube 23, the inner diameter should preferably range from 0.2 mm to 50 mm; a diameter less than 0.2 mm cannot provide the ink with a smooth flow due to friction produced in the tube; on the other hand, a diameter more than 50 mm can offer poor effect of stirring and of protecting the ink from forming precipitates in the second tube 24. Forming a part of the first tube 23 into a flexible structure offers an easy supply of the ink to the printer head. As for the second tube 24, the inner diameter should preferably range from 0.1 mm to 10 mm; a diameter less than 0.1 mm cannot provide the ink with a smooth flow; on the other hand, a diameter more than 10 mm allows a certain type of ink to form precipitates in the tube.

On the other hand, in the conventional ink jet apparatus shown in FIG. 16, the bubbles flow through the tube into the printer head. Even if a bubble-trap unit is attached, the unit will reach capacity and be full of bubbles before a long-hours printing completes. Whereas, the apparatus of the present invention having a design idea in connection of the first tube 23 and second tube 24, traps bubbles so as not to flow into the printer head. It is therefore possible to provide a long-hours printing while maintaining high quality.

Third Embodiment

Figure 6A:
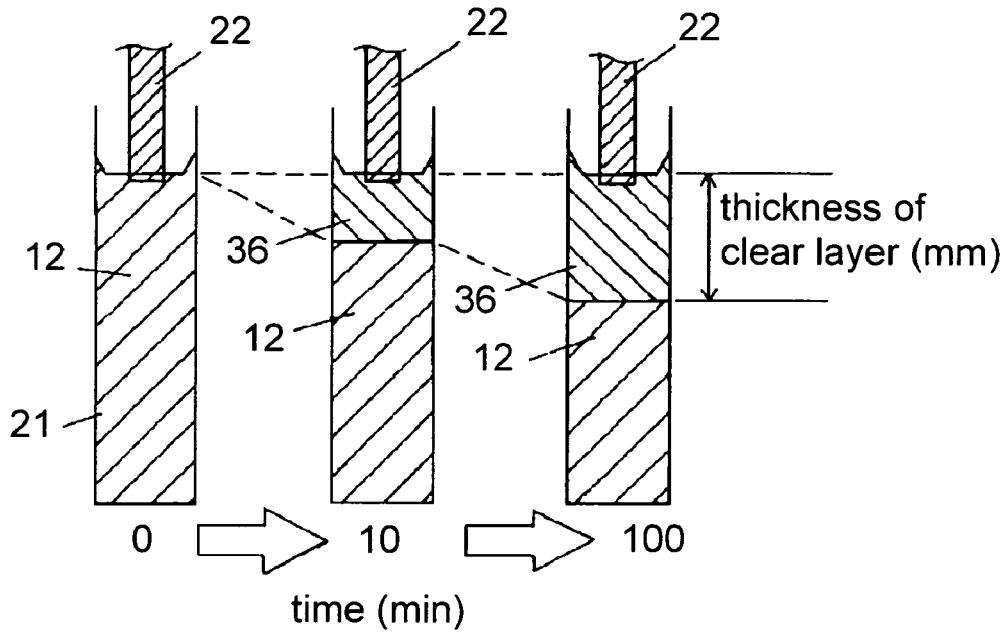
FIGS. 6A and 6B show data obtained by measurement of precipitation velocity of practically used ink for manufacturing electronic components.
Figure 6B:
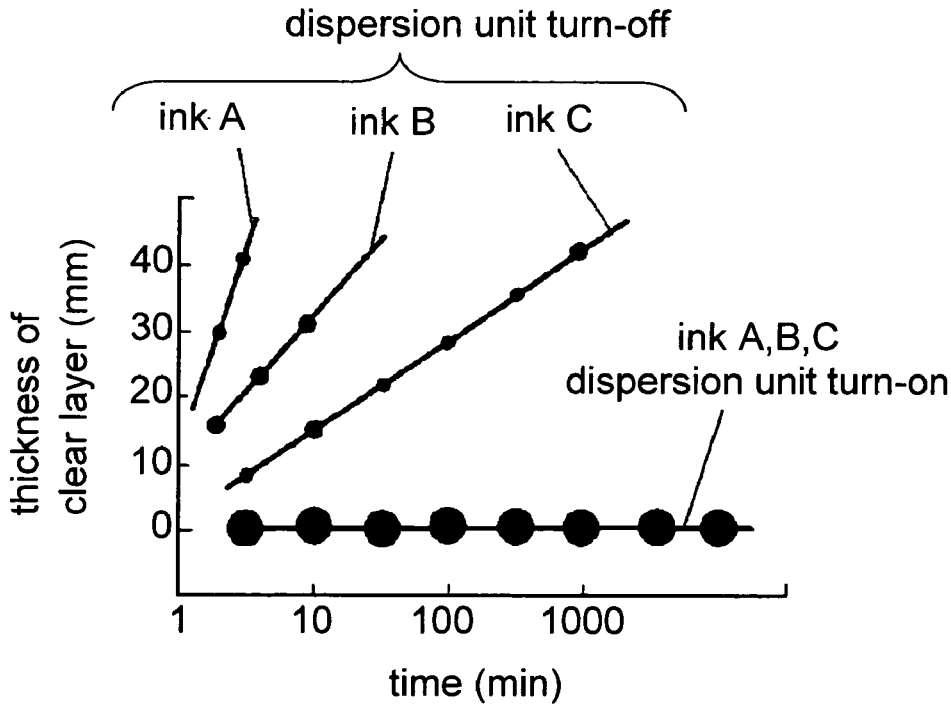

In a third embodiment, a more detailed explanation of a distinctive feature of the present invention—circulation and dispersion of ink—will be given hereinafter. FIGS. 6A and 6B show data obtained by measurement of precipitation velocity of practically used ink for manufacturing electronic components. In particular, the ink for manufacturing electronic components has an extremely easy-to-aggregate property, thereby it tends to form precipitates. Here will be given a more detailed explanation of the aforementioned property, referring to FIGS. 6A and 6B. In FIG. 6A, ink tank 21 is filled with ink 12. Dispersing unit 22 is put into ink 12, with a switch being OFF(switch off). When dispersing unit 22 is kept in OFF mode, i.e., the ink is left with no movement, as shown in FIG. 6A, clear layer 36 appears in ink 12 with passage of time. Clear layer 36 grows thicker as time goes by. FIG. 6B illustrates a process of developing each clear layer in three types of ink for manufacturing electronic components. Although a container storing ink has a clear layer 36 at a surface and, at the same time, a precipitation layer at a bottom, here will be focused on clear layer 36. Each small black dot in FIG. 6B indicates a moment at which dispersing unit 22 is turned to OFF. Precipitate of ink A has a few centimeter thickness only after a few minutes standstill. In ink B and ink C, precipitates grow to 30 mm and 15 mm in thickness, respectively, after about 10 minutes of standstill. Since these three types of ink A through C are for manufacturing electronic components, turning OFF the switch of the dispersing unit, i.e., going into a standstill mode starts to form precipitates (aggregates) in each ink. In a conventional apparatus, this easy-to-aggregate property of the ink has been an obstacle to high quality ink jet printing. In FIG. 6B, each big black dot indicates a moment at which dispersion unit 22 is turned ON. As is apparent from the graph, turning ON the switch of the unit inhibits growth of precipitates in ink A, B and C. According to the present invention, ink circulates between the first tube and the third tube 26, with the dispersing unit kept ON until being fed to the printer head, whereby printer head 16 can receive well dispersed ink 12, that is, ink without precipitates or aggregates.

To observe growth of precipitates in the ink, pour the ink into a container with a depth ranging from 3 cm to 100 cm, and leave it in a standstill state. The ink in the container should be left for at least one hour and at most 100 hours. In the ink having a standstill time of less than one hour, natural convection can develop due to temperature difference or the like; on the other hand, more than 100 hours of standstill time is too long to be practical. In a container with a depth of less than 3 cm, it is not easy to obtain data—differences in concentration, density, and specific gravity. On the other hand, a container with a depth of more than 100 cm is too large to be practical. Although the container can be made of metal, transparent material, such as glass and resin, are more preferable for the container because they offer easy-to-see observation of a process of forming precipitates in the ink. Some ingredients of ink deposit, due to its property, to an inner surface of the container. Considering this, it is preferable to provide the inner surface of the container with an appropriate treatment.

Providing circulation, as described above, allows the ink for electronic components—even if it forms precipitates at extremely high rate: few centimeters per approximately one minute—to have substantially no precipitates. Putting ink tank 21 into a commercially available ultrasonic cleaning tank can obtain a good effect; horn-type ultrasonic dispersing unit should preferably be employed. In this case, because of the structure in which the ultrasonic oscillator of the unit is directly put into the ink, a temperature of the ink elevates. To prevent this, the ultrasonic dispersing unit should preferably be timer-controlled so as to be regularly switched between ON and OFF. Cooling ink tank 21 and the tubes also suppresses heat of the ink. Such treatments allow the ink—even the ink that starts to form precipitates in a minute—to provide printed output with stability.

According to the third embodiment, in particular, powders contained in the ink are subjected to a shearing stress (in other words, shearing velocity), which is explained in the Hagen-Poiseuille's law, in addition to the Brownian movement by ink 12 flowing through first tube 23. Therefore, the ink in the tube has no precipitates or aggregates. Besides, increasing a velocity of flow of the ink, or decreasing a diameter of the tube can cause turbulent flow in the ink, not laminar flow. The turbulent flow can strongly stir the powders in the ink. With reference to Reynolds number, a difference between the turbulent flow and the laminar flow can narrowly be distinguished. Locally decreasing the diameter of the tube can develop turbulent flow in a part of the ink-circulating system. Similarly, disposing an obstacle in the tube can physically develop turbulent flow, which conveniently stirs the ink in the tube. On the other hand, locally increasing the diameter of the tube can develop laminar flow in an area leading to second tube 24. Taking this phenomena occurred in the ink into account, an ink-circulating system suitable for each ink for electronic components can be obtained. For observing flow of the ink in the tube, a transparent tube should preferably be employed. According to an experiment by the inventors, observations of flow of some fine bubbles developed in black nickel-ink enabled realization of a behavior of the ink. An approach on aerodynamics using a wind tunnel, which is used for designing bridges and airplanes, contributes to visualization and analysis of flow of ink.

Fourth Embodiment

In a fourth embodiment, an example in which a filter is added to the ink-circulating system will be described. Attaching the filter in a midpoint of the first tube can filter out precipitates and aggregates developed in the tank just before ink jet printing. This filtering allows the ink jet apparatus to offer stabilized printing for electronic components even when the ink used is easy-to-aggregate ink. The filter is available in the market. Using a commercially available disposable filter can lower a possibility of foreign matter intruding into the tube when replacing the filter with new one. Employing a filter having large area of filtration as necessary can suppresses pressure loss. Besides, attaching the filter to a midpoint of the third tube can filter out precipitates and aggregates developed in the ink, thereby allowing the ink jet apparatus to offer printed output with stability.

Now will be given more detailed explanation. As for ink tank 21 shown in FIG. 1A, a 100 ml glass beaker is employed. Ink 12 (will be described later) is filtered by a 5 μm filter into the beaker. As first tube 23, a plastic tube with an inner diameter of 4 mm and an outer diameter of 6 mm was employed and put into ink stored in the beaker. A commercially available 10 μm filter was attached in a midpoint of first tube 23, so that the ink filtered through it flowed in the second tube. A filter being resistant to clogging should preferably be attached to the tube 23. The filter disposed in a midpoint of the tube should preferably be looser than that used in filtering ink into the beaker; when the ink is filtered by a 5 μm filter, a 10 μm filter should preferably be attached to the first tube.

Ink 12, which was thus circulated through the filters, provided printed output with stability for long duration printing.

Figure 14:
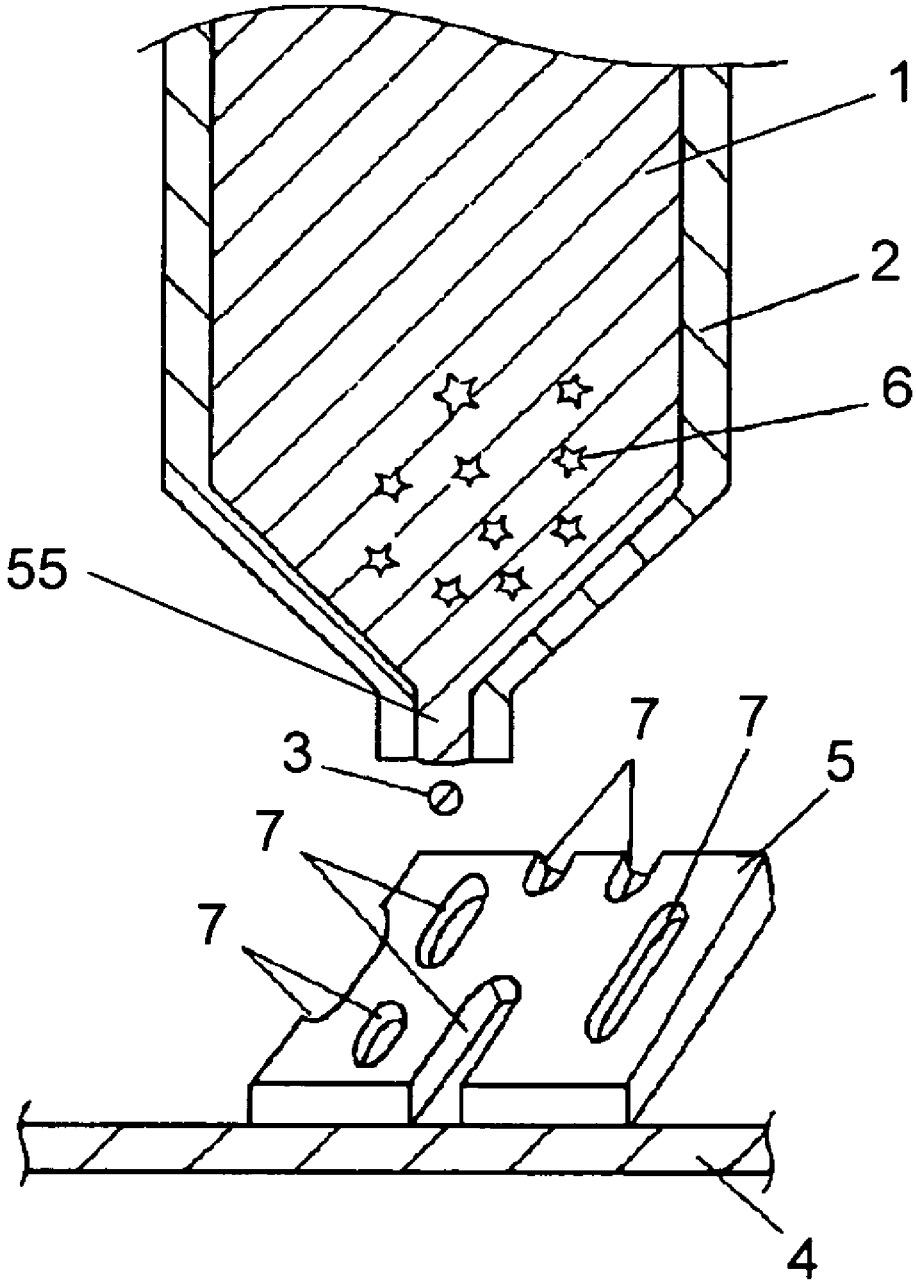
FIG. 14 illustrates a problem occurring in forming an electronic circuit by ink jet printing.

Comparing to printing with using apparatus filters, the inventors performed continuous printing without using filters. Some types of ink could not offer consistent printing. In the printing with filters, in contrast, fine bubbles 29 in addition to aggregates were removed, whereby more than 10 hours of printing with stability was achieved. Next, adding separately formed aggregates having the size of tens of microns—the size equivalent to that of aggregates 6 in FIG. 14—into ink 12, the inventors performed continuous printing with and without filters. An experiment without filters could not achieve printing with stability, whereas the printing with filters provided a good result with stability for more than 10 hours. These experiments proved that filters inserted in the path of the ink can filter out aggregates from ink 12.

Fifth Embodiment

Figure 7:
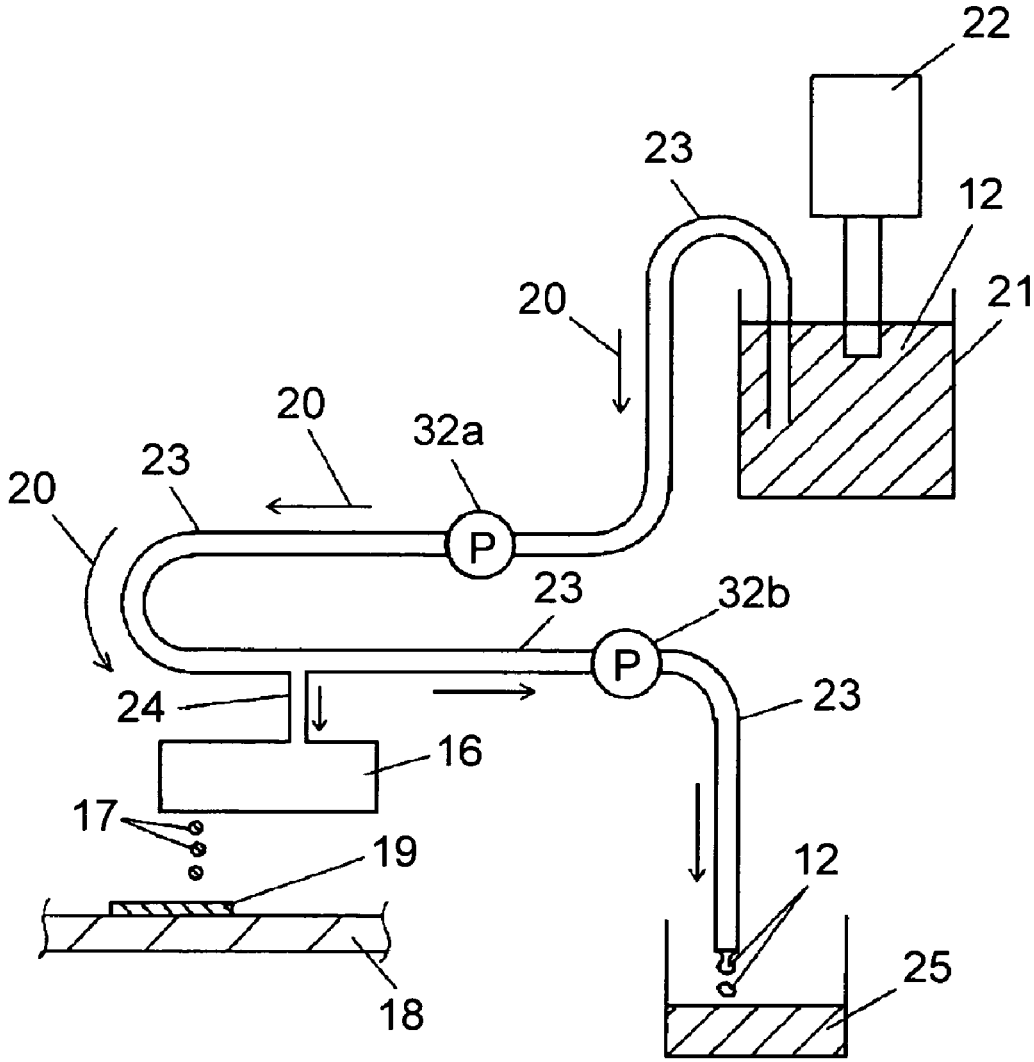
FIG. 7 illustrates an example in which pumps are added to a part of an ink-circulating mechanism.

Here in a fifth embodiment an example in which a pump is fixed to a part of the ink circulating system is explained with reference to FIG. 7. In FIG. 7, pumps 32*a*, 32*b* are each fixed at a part intermediate of first tube 23 so as to be inserted with second tube 24 between these pumps. Fixing pumps to the first tube 23 so as to have tube 24 therebetween can control a flow rate and pressure of ink 12. Employing pump 32 enhances circulation of ink through ink tank 21 and ink-collecting tank 25. When printer head 16 is over-pressurized by the ink, ink 12 comes to ooze or drip down, by its own weight, from printer head 16, which makes it difficult to provide a stabilized printing. In this case, delivery pressure of pumps 32*a* and 32*b* can be adjusted to avoid the ink coming out by its own weight from printer head 16.

Besides, mounting a pressure sensor on second tube 24 or printer head 16 can automatically perform pressure control according to feedback data on pressure applied to the ink. Such pumps can be fixed to not only first tube 23, but also second tube 24 or third tube 26. Mounting a pump on second tube 24 minimizes variations in an amount of flow, a velocity of flow, and pressure of the ink flowing through first tube 23. This allows printer head 16 to provide good printing with stability. Mounting pump 27 on third tube 26, as shown in FIG. 2, provides the ink with a good circulation.

A commonly used tube pump or diaphragm pump often develops a pulsating current in which an amount of flow changes with passage of time, like the bloodstream of the human body. If such pumps are employed for pumps 32*a* and 32*b*, a pulsating current produced by each pump can change a size (or volume) of droplets 17 jetted from printer head 16. This adversely affects a flying speed of droplets 17 or a time required for landing on substrate 18 to be printed, whereby a pattern is deformed. A pump for the present invention should preferably have fluctuations of pressure within ±50% (preferably, ±10%). For example, a tube pump having a structure in which a combination of a plurality of rotating sections suppresses the pulsating current, HEISHIN Mono-pump manufactured by HEISHIN Ltd., and a sign-pump should preferably be used. Suppressing the pulsating current within ±10% can offer stabilized printing. If a pulsating cycle has a high frequency, for example, higher than 1 kHz, this pulsation interferes with a driving signal of printer head 16 and printing quality becomes inconsistent. According to an experiment performed by the inventors, a noticeable effect on printing could not be observed in a cycle of a pulsating current ranging from 0.01 to 100 seconds.

Sixth Embodiment

Figure 8:
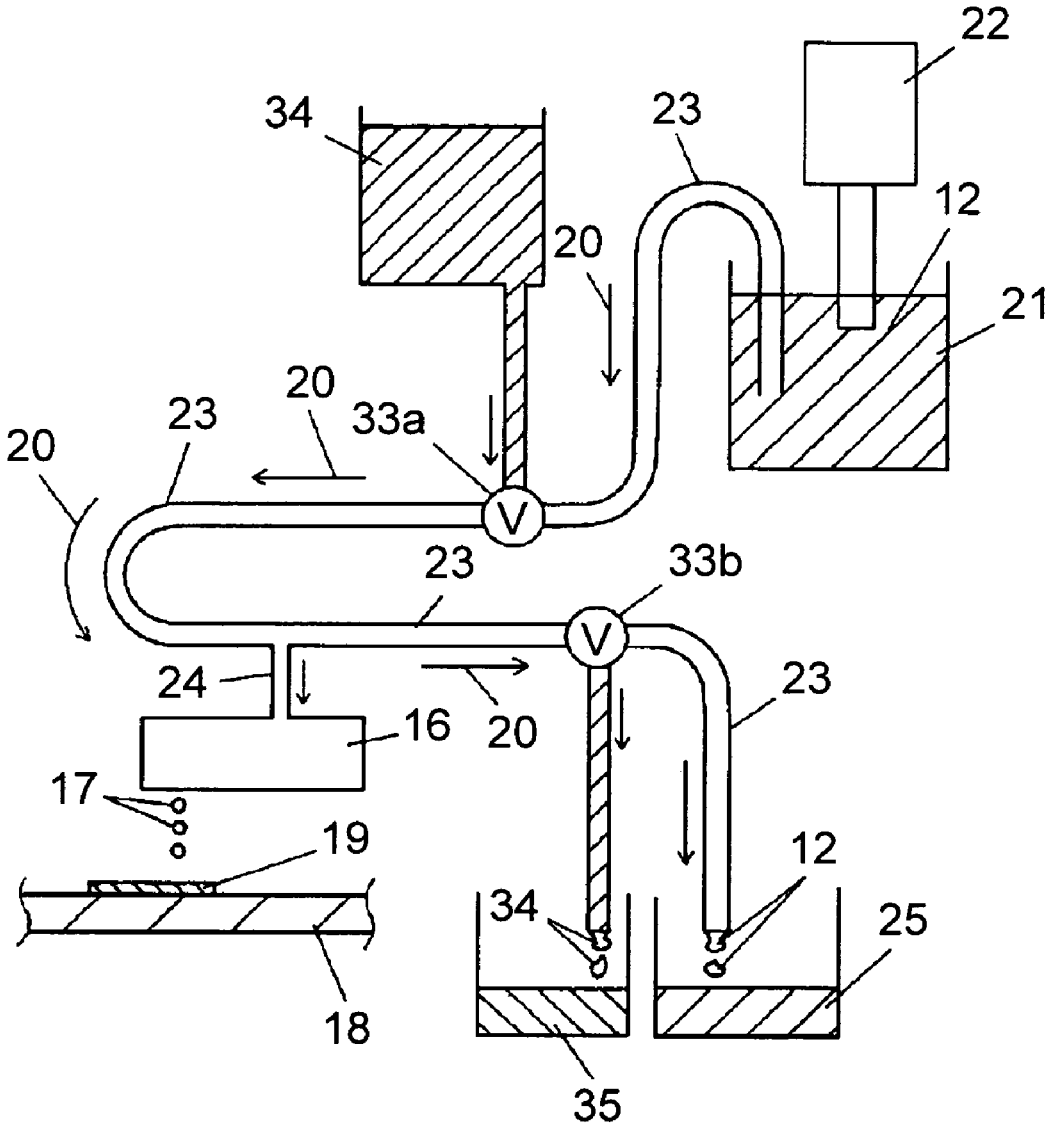
FIG. 8 illustrates an example in which valves are fixed to a part of an ink-circulating mechanism.

Here in a sixth embodiment an example in which a valve is fixed to a part of the ink-circulating system is explained with reference to FIG. 8. In FIG. 8, valves 33*a*, 33*b* are each fixed at a part intermediate of first tube 23 so as to be inserted across second tube 24. Fixing valves to the first tube so as to have tube 24 therebetween can control a flow rate and pressure of ink 12. Employing the valves enhances circulation of ink through ink tank 21 and ink-collecting tank 25. When printer head 16 is over-pressurized by the ink, ink 12 comes to ooze or drip down, by its own weight, from printer head 16, which makes difficult to provide a stabilized printing. In this case, delivery pressure of valves 33*a* and 33*b* can be adjusted to avoid the ink coming out by its own weight from printer head 16. Besides, mounting a pressure sensor on second tube 24 or printer head 16 can automatically perform pressure control according to feedback data on pressure applied to the ink. A valve can be fixed to not only first tube 23, but also second tube 24 or third tube 26. Fixing this valve to second tube 24 minimizes variations in an amount of flow, a velocity of flow, and pressure of the ink flowing through first tube 23. This allows printer head 16 to provide good printing with stability. Fixing the valve to third tube 26, as shown in FIG. 2, provides the ink with a good circulation. In FIG. 8, cleaning fluid 34 is set in a container. Switching valve 33*a*, as required, allows cleaning fluid 34 to travel through first tube 23, second tube 24, and printer head 16 for performing cleaning, and then finally reach waste ink tank 35. After being cleared of ink 12, the ink dispersion/circulation system is cleansed with cleaning fluid 34. This allows a single ink jet apparatus to be shared with inks having different properties or having sensitive properties, whereby various electronic components can be produced at low cost.

In particular, an amount of jetted ink is often subject to factors including: a viscosity of the ink; a quantity of flow; thickness or length of the tube. The ink circulation system having a flexible combination of pumps 32*a* or 32*b* and valves 33*a* or 33*b* not only provides stabilized printing, but also introduces total automation of steps of ink setting, such as a first setting of ink; manufacturing electronic components; and collecting the ink or cleaning the tubes. This automated ink-setting process can manufacture electronic components having a lower cost and improved printing quality. This also can establish a totally (or locally) automated dust-free printing environment.

As for the tube, a transparent plastic tube is preferable. This transparent tube apparently shows a presence or absence of bubbles, residual ink, and a residue after a cleaning process. As for cleaning fluid, ink for electronic components, which does not contain powdery components such as metallic powder and glass powder, can be employed. That is, a solution, which is formed of water as a solvent, an organic solvent, a dispersant substance including poly(oxyethylene)alkylethyl and polycarbonic acid, and a resin substance including cellulose or vinyl type resin, can be employed. Employing ink having no powders, such as a metal powder and a glass powder, as a cleaning fluid produces little ill effect on a process of manufacturing electronic components, even if the cleaning fluid mixes with the ink for manufacturing electronic components. To the contrary, employing a commercially available cleaning fluid containing water and several types of surface active agents as constituents sometimes developed precipitates when this cleaning fluid mixed with an in-house manufactured ink for electronic components.

It is preferable to use a flexible tube. This flexibility allows the tube to have simple attachment to a commercially available ink jet printer equipped with a movable printer head (for example, model MJ 510 C printer manufactured by EPSON Inc.). Applying a gentle sway to the tube can prevent the ink from forming precipitates and aggregates. Other than the tube pump, a diaphragm pump and commercially available pumps equipped with a pulsating current protection mechanism can be employed. In addition, applying pressure, for example, by air, to a hermetically sealed ink tank can induce circulation of ink without using pumps.

If an ink exhibiting high thixotropy runs through a tube with a large diameter, a fluidized area insensitive to a shearing stress—called "plug flow"—often appears in a middle of the tube. This area tends to collect aggregates. To prevent the plug flow, it is preferable to employ a tube with a smaller diameter and control an amount of flow so as to range from 0.1 ml per min. to 200 liters per min. When a large amount of ink more than 200 liters per min. runs through the tube, ink spouting section 55 often fails to provide a constant amount of ink jetting. According to the present invention, monitoring droplets 17 jetted from printer head 16 can optimize a quantity of flow of ink. To be more specific, monitoring droplets 17 in synchronization with a flash and a charge-coupled device (CCD) camera clearly shows a shape of the droplets. Getting feedback from these observations enhances quality of printing. An experiment performed by the inventors showed that some types of ink for electronic components provided a more consistent amount of ink jetted from ink spouting section 55 when using a tube that is several meters long as opposed to using a shorter tube. Ink is well dispersed during traveling through the long tube. The tube should preferably be transparent or translucent. Besides, applying an appropriate treatment to an inner wall of the tube not only prevents the tube from acumulation of some ingredients of the ink, but also provides an easy cleaning.

A diameter of an ink jetting opening of the ink jet apparatus, i.e., an opening of the printer head for jetting the ink, is preferably less than 200 μm. When the diameter is larger than 300 μm, ink can ooze out from the opening due to circulation of the ink. Forming a plurality of ink jetting openings in the head with a predetermined pitch can respond to an improved design in which a plurality of printer heads are aligned with accuracy. This allows the printer to print not only a broader area at a time, but also at a faster speed.

Seventh Embodiment

Figure 9:
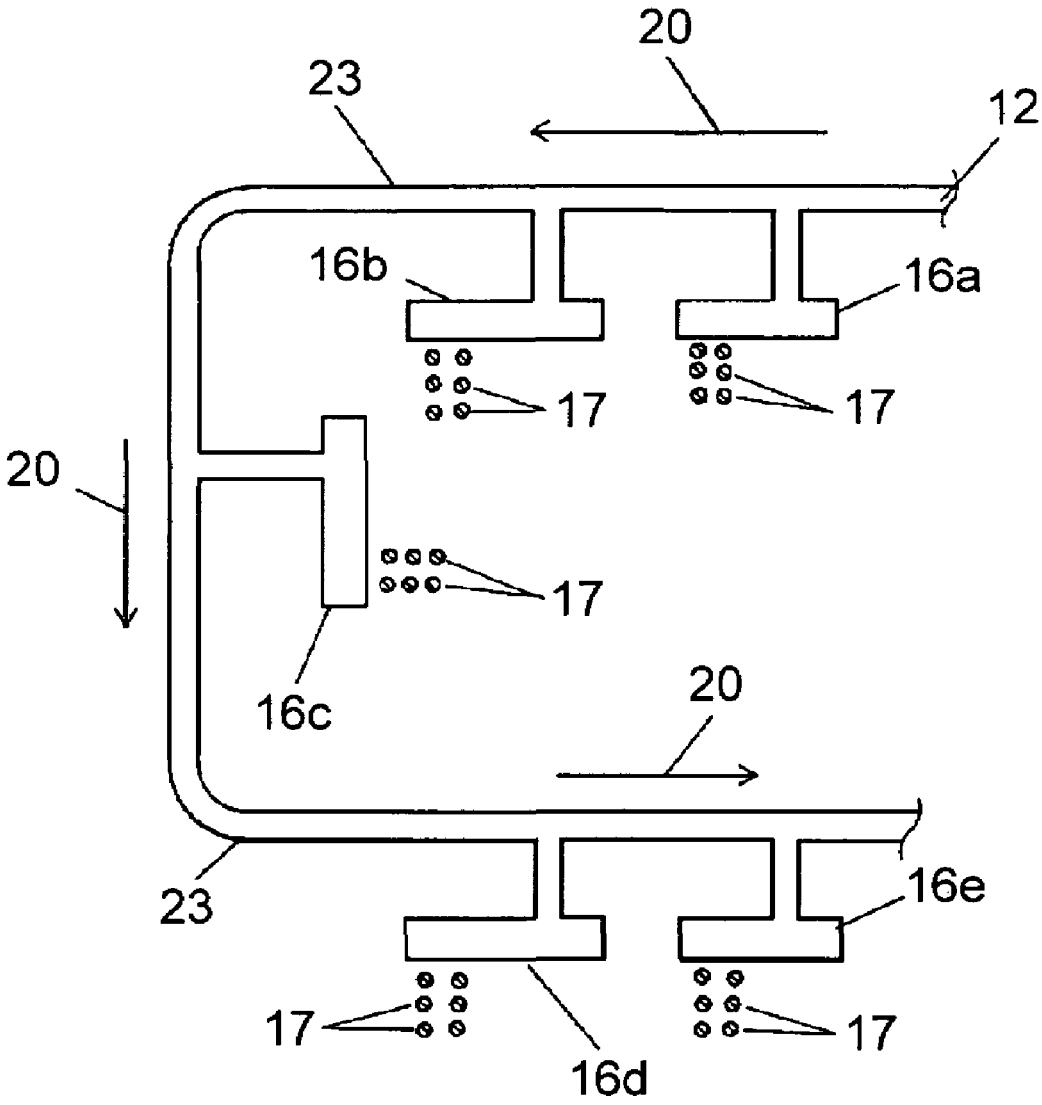
FIG. 9 illustrates a case in which ink is jetted at a single time from a plurality of heads using a single ink-dispersing/circulating mechanism.

Here in a seventh embodiment an example of simultaneous printing performed by a plurality of printer heads, using a single ink dispersing/circulating mechanism, is explained with reference to FIG. 9. In FIG. 9, first tube 23 contains a plurality of printer heads 16*a* to 16*e*. In the seventh embodiment, as described above, a plurality of printer heads (or printers) forms an ink pattern, using ink 12 fed from a single ink tank. This structure having plural heads can achieve high-speed printing several to dozens of times faster—depending on a number of the heads employed—than that having a single printer head. In the dispersing/circulating mechanism of the embodiment, the ink, which is fed from the single ink tank, is distributed to a plurality of ink jet apparatuses. This structure has an advantage of not only accommodating variations in characteristics of electronic components occurred between the apparatuses, but also using a small amount of ink with efficiency.

Eighth Embodiment

Figure 10A:
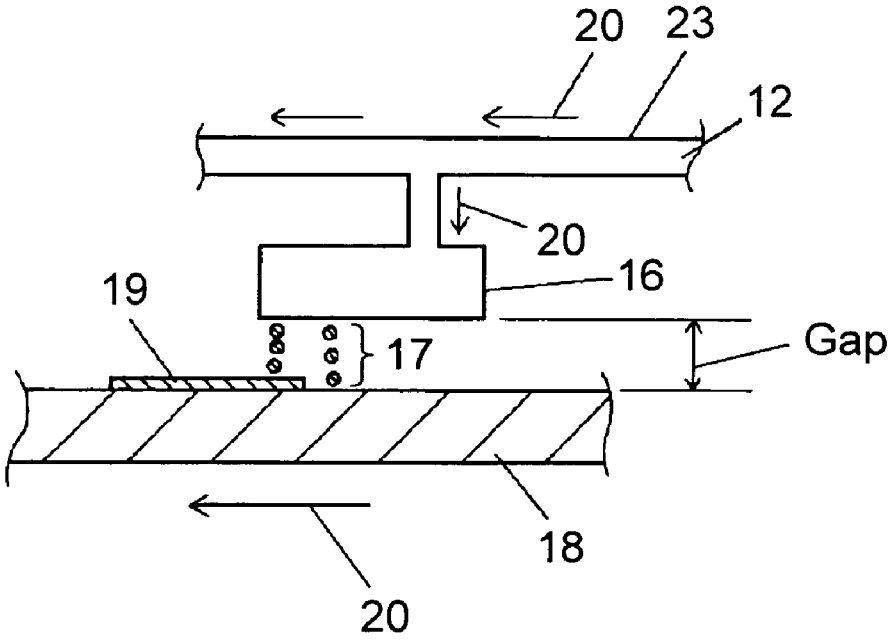
FIGS. 10A and 10B illustrate a relationship between a printing velocity and a deviation from a correct position to be ink jetted, with a gap between a printer head and a surface of a substrate varied.

In an eighth embodiment, an explanation of print speed will be given, referring to FIGS. 10A and 10B. FIG. 10A shows a state in which substrate 18 to be printed (or printer head 16) moves at high speed. In this figure, "Gap" represents an interval between substrate 18 and head 16.

Figure 10B:
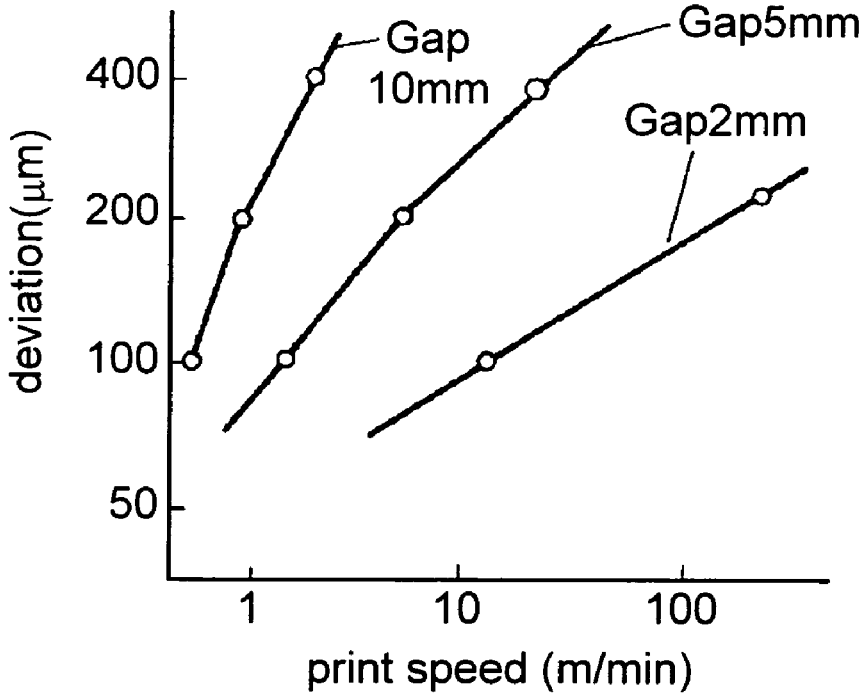

FIG. 10B shows a relationship between a print speed and a deviation from an intended position to be ink jetted, with the "Gap" between the printer head and a surface of the substrate varied. In printing with a 10-mm Gap, as is apparent from FIG. 10A, the deviation becomes abruptly larger as the print speed increases. In decreasing the Gap to 5 mm, the deviation becomes smaller in comparison with printing using a 10 mm Gap. By decreasing further the Gap to 2 mm, the deviation becomes further smaller. As described above, a narrower Gap can provide a smaller deviation and achieve faster print speed. In other words, to achieve a print speed of more than 10 m per min., Gap should be narrowed as possible. An experiment performed by the inventors demonstrated that the ink jet apparatus for manufacturing electronic components, which has a print speed of more than 10 m per minute at a Gap less than 2 mm (preferably less than 1 mm), well achieved a practical level.

As an example of an ink jet apparatus in which ink is circulated at all times, a continuous type apparatus is well known. This apparatus, which was invented by Prof. Richard Sweet at Stanford Univ. in the U.S., has been marketed through Videojet Co., and other dealers. The apparatus can cope well with an easy-to-aggregate ink containing powders due to its circulation mechanism, thereby providing a printed output with stability. In this continuous type apparatus, however, because electrical charge deviates droplets jetted from a printer head away from a position to be landed, a size of a pattern widely varies from several to dozens of times—from a few millimeters to several tens of millimeters on a deviation basis—depending on an interval between the printer head and a surface of the substrate. In contrast, the apparatus of the present invention, as shown in FIG. 10B, has not so much variations in the size of the pattern. In the continuous type apparatus, because a total amount of the ink is circulated and jetted from a predetermined printer head, an amount of flow and a velocity of flow of the ink are determined by an amount of ink jetted from the head. On the other hand, in the apparatus of the present invention, the head jets required an amount of the ink flowing through the tube. Therefore, the amount of flow and the velocity of flow of the ink in the tube can be freely controlled regardless of the amount of ink jetted from the printer head. This fact allows the apparatus to cope well with ink that cannot offer a good printed output in the continuous type apparatus, thereby providing printing with stability. Furthermore, in the continuous type apparatus, the ink is easy to dry because of being exposed to air every time it is circulated. In contrast, in the present invention, a major portion of the ink circulates in the tube, which prevents the ink from direct exposure to outside air, thereby maintaining the ink in a good condition. Additionally, covering a top of the ink tank or the ink-collecting tank with a lid can retard drying further effectively.

Figure 11:
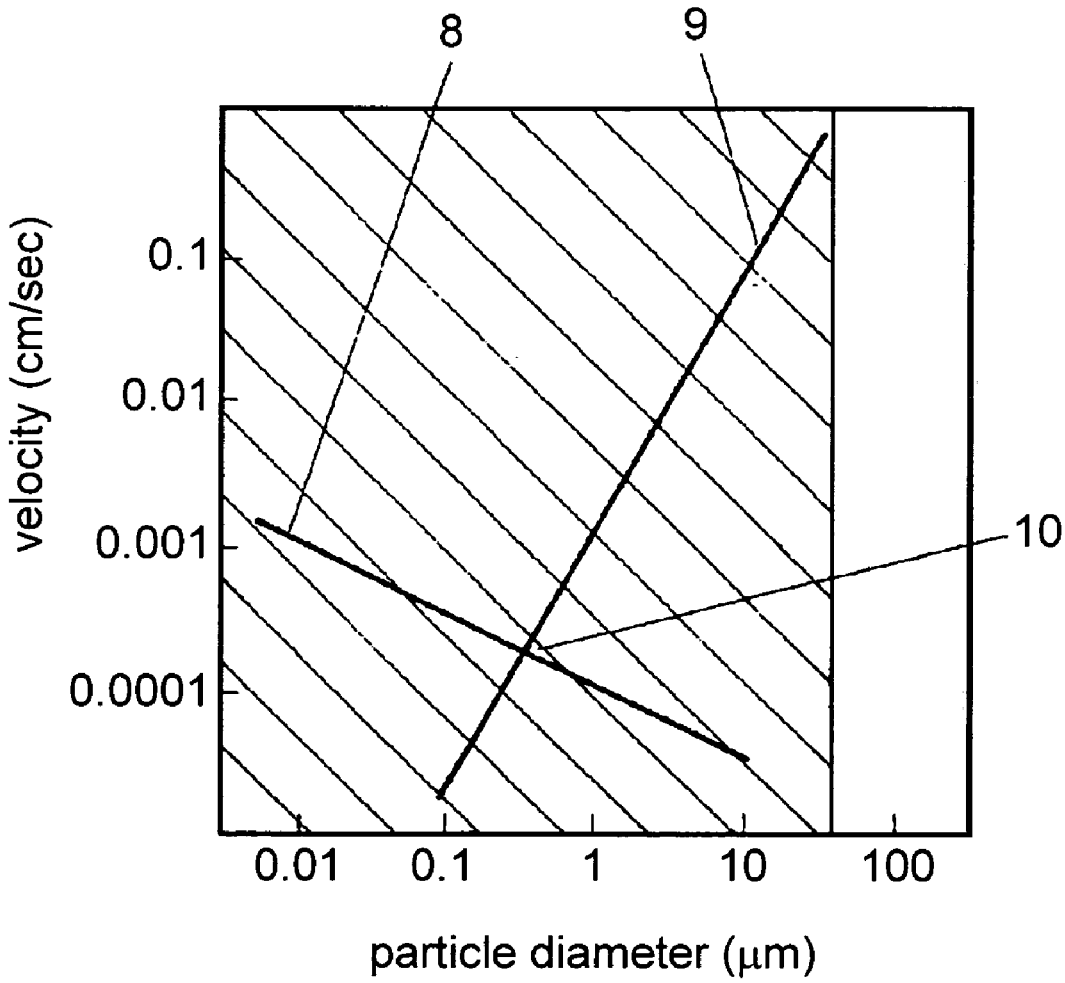
FIG. 11 shows coverage of ink jet printing by the apparatus of the present invention.
Figure 15:
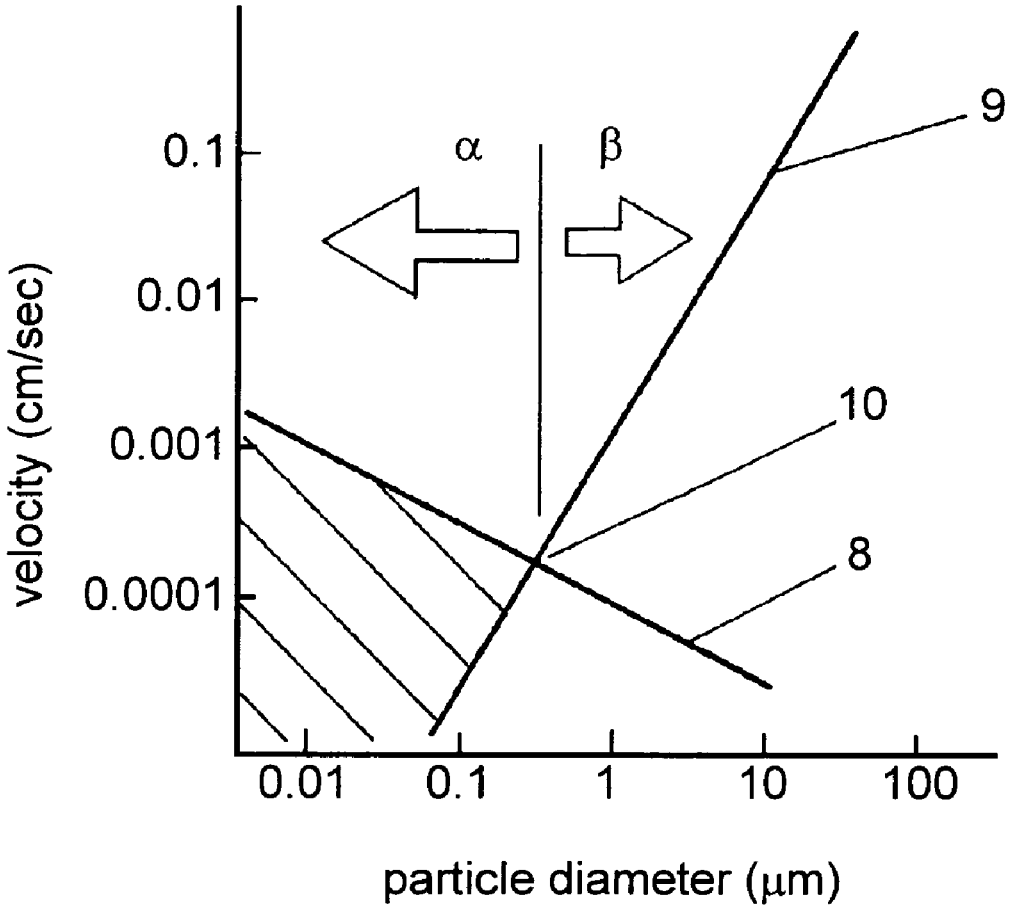
FIG. 15 is a graph relating precipitates and aggregates developed in an ink for manufacturing electronic components.

FIG. 11 shows coverage of ink jet printing by the apparatus of the present invention. When compared to FIG. 15, FIG. 11 apparently shows that the apparatus of the present invention has an increased coverage of ink jet printing (indicated by a cross-hatching area). In FIG. 11, the Y-axis represents velocity (cm/sec) of powder, and the X-axis represents a particle diameter (μm) of the powder. The cross-hatching area in FIG. 11 represents the coverage of ink jet printing by the ink dispersing/circulating mechanism of the present invention. Conventionally, narrow cross-hatching area in FIG. 15 is an area in which ink jet printing is possible by the prior-art apparatus. Besides, as higher concentration is required for ink for electronic components in a practical use, good printing quality is not obtained even in the narrow cross-hatching area. Whereas, the apparatus of the present invention can cope well with highly concentrated ink, thereby providing stabilized printing in a broader range indicated by the cross-hatching area in FIG. 11. Conventional printing methods have been subjected to constraints of the Brownian movement and the Einstein-Stalks's precipitation movement. The present invention can be free from these constraints by fluidizing (moving) ink itself.

A particle diameter of the powder of the ink employed in the present invention should preferably range from 0.001 μm to 30 μm. Ink with a particle diameter of less than 0.0005 μm will not achieve an intended property as an electronic component, and at the same time, such fine powder is too expensive for practical use. On the other hand, ink with a particle diameter of more than 50 μm can clog a printer head despite circulation in the tube, so that a yield of a product is lowered. As for ink for manufacturing electronic components, a particle diameter should preferably range from 0.01 μm to 5 μm—some products demand to be more than 0.05 μm and less than 3 μm. A size of a particle diameter is measurable with Particle Size Distribution Analyzer. Examining dried ink under a scanning electron microscope or the like can easily obtain a measured particle diameter. As for a specific gravity of powders to be added to the ink, a preferable range is: more than 2.0 for metal powders; and more than 1.5 for powders of ceramic, glass, and dielectric material. A powder with a specific gravity of less than these values has no harm in printing; however, it increases cost. In a case of employing plastic powder, the specific gravity should preferably be more than 0.6. In the apparatus of the present invention, a powder with a specific gravity of less than 0.5 easily surfaces on the ink in spite of being well dispersed.

The powder contained in the ink should preferably range from 1 weight % to 85 weight %; ink containing powder less than 0.05 weight % cannot often offer intended electrical characteristics or images. On the other hand, ink containing powder more than 90 weight % has poor dispersion in spite of being well-dispersed in the ink tank, so that it can clog the printer head; or, it can promote ink drying, or vary a viscosity of the ink. As for the viscosity of the ink employed for the present invention, it should preferably be less than 10 poises. When the viscosity exceeds 20 poises, a printer cannot often jet ink in an intended direction, whereby precision in ink landing is lowered; that is, a yield of products is lowered. An experiment performed by the inventors found that a lower viscosity of the ink is preferable for our purpose. Consequently, a viscosity ranging from 0.05 to 1 poise is much better. In the present invention, ink is subject to a shearing stress in the tube. This allows the apparatus to handle ink having high viscosity, which has been impossible to be handled with the prior-art apparatus. Measurement of viscosity of ink should preferably be done at two different shearing rates: (1/sec.) and (1000/sec.). In the conventional ink jet printing, due to difficulty in handling ink having high viscosity, a printer cannot provide stabilized quality in printing unless the viscosity is at most 0.002 poises measured at a shearing rate of (1/sec.) and (1000/sec.). On the other hand, by virtue of the shearing rate advantageously working on the ink in the tube, the apparatus of the present invention can cope with a viscosity, which measures less than 10 poises at the shearing rate of (1000/sec.), even if it measures more than 100 poises at the shearing rate of (1/sec.). The apparatus of the present invention, as described above, can handle ink that exhibits high thixotropy and provide stabilized printing. In ink exhibiting high thixotropy, a powder contained in the ink is hard to solidify. Processing ink so as to have thixotropy can provide the ink with ease of use; adding only a light stir allows the ink to get ready for operation even after being left in a standstill state for months.

Ninth Embodiment

In a ninth embodiment, an ink for various electronic components, which contains metallic powder, and a method using the ink are explained.

As for ink for electrodes, palladium (Pd) ink using organic solvent was prepared. To be more specific, at first, Pd powder (100 g) having a particle diameter of 0.3 μm is added to an organic solvent (220 g), that has a small amount of additives, in advance. Next, this mixture was subject to dispersion for hours using 0.5 mm diameter zirconium beads for mixing. Then, the solvent is filtered by a 5 μm membrane filter to form solvent-based ink 12 with a viscosity of 0.05 poises.

As for substrate 18, a ceramic green sheet is employed. To manufacture a laminated ceramic capacitor, as shown in FIGS. 1A and 2, an inner electrode is formed by ink jet printing. Ink 12 produced above is set in ink tank 21. A commercially available magnet stirrer is employed for dispersing unit 22 to prevent ink 12 from forming precipitates and aggregates. Ink 12 stored in ink tank 21, as shown in FIG. 1A, naturally flows on the siphon principle to reach ink-collecting tank 25, then it flows, as shown in FIG. 2, back to ink tank 21 via ink-recycling unit 28.

Now will be described the organic ceramic green sheet. First, prepare a dielectric powder made mainly of barium titanate with a particle diameter of 0.5 μm. The dielectric powder has X7R-property—a property in which a rate of change of capacity is maintained within +15% at a temperature ranging from −55° C. to 125° C. In order to form a dielectric slurry, disperse the aforementioned dielectric powder with butyral resin, phthalic acid plasticizer and an organic solvent. Then filter the slurry by a 10 μm filter and apply it onto a resin film. In this way, a ceramic green sheet with a thickness of 30 μm was produced.

Next, as a printing experiment, spout ink 12, which is circulated through the ink circulating mechanism of FIG. 1A, onto the organic ceramic green sheet. In the experiment, resolution of printing was determined at 720 dots per inch (dpi). In this way, make dozens of the ceramic green sheets, each of which has electrodes formed by ink jet printing, and laminate them one on another to form laminated ceramic green sheets. Cut the green sheets into predetermined pieces and bake them, and finally form external electrodes to complete laminated ceramic capacitors. A laminated ceramic capacitor thus manufactured exhibited the same property as designed specifications. In the method of manufacturing electronic components of the present invention, an electrode pattern can be corrected by computer-aided design (CAD) applications, or at least a feedback system is available on a quick on-demand basis. Accordingly, when a ceramic green sheet, which is formed of materials having different lots or different dielectric constants, is employed, a maximum property of products, with high yields, can be obtained within an intended capacity of products.

Figure 16B:
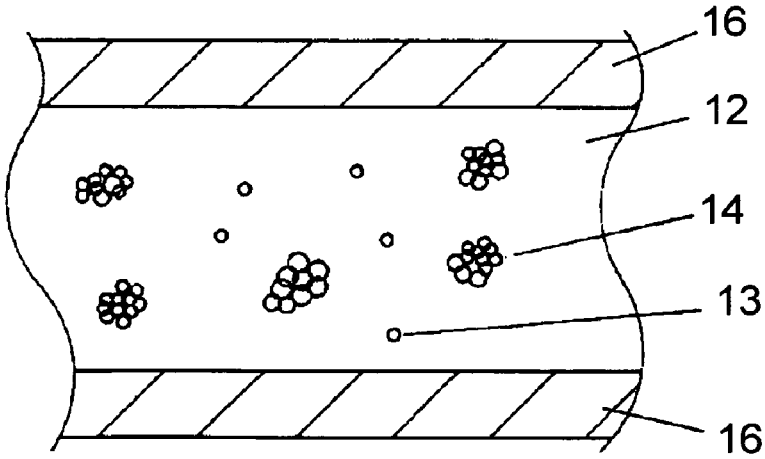

For a comparison purpose, the inventors performed ink jet printing without ink-dispersion/circulation. First, remove an ink cartridge from a commercially available ink jet apparatus and wash dye ink away from the cartridge. Then, as shown in FIG. 16A, set the aforementioned organic solvent-based palladium (Pd) ink, which is filtered by a 10 μm filter, to the ink cartridge without dispersing and circulating. However, the ink jet apparatus failed in terms of printing. From measurement of particle distribution with use of Particle Size Distribution Analyzer, aggregates with a particle diameter more than 5 μm were few in an ink. When the inventors disassembled the ink spouting section of the ink jet apparatus, a lot of precipitates 14, as shown in FIG. 16B, was observed. The inventors assumed that the Pd ink formed precipitate, as the explanation given in FIG. 15, by its own weight due to large specific gravity (12.03) of Pd and low viscosity of the ink. Then ink 12 was stirred well in a test tube and left in a standstill state. About ten minutes later, as shown in FIG. 16A, Pd particles in the ink were forming precipitates. After all, the commercially available ink jet apparatus failed in terms of printing with ink 12. On the other hand, keeping the switch of dispersing unit 220N prevents ink 12 from forming a clear layer. This time, a printing experiment was performed in such a way that well dispersed ink 12 is set to the ink jet apparatus, with an ink circulation mechanism used. Printing was successfully performed, even after a several hours intermission by virtue of no precipitation of Pd particles. According to the embodiment, as described above, providing dispersion and circulation allows ink containing powders with large specific gravity, i.e., easy-to-precipitate by its own weight, to provide stabilized printing.

As for the organic solvent, alcohol including ethyl alcohol and isopropyl alcohol; ketone group including acetone and methyl ether ketone; ester including butyl acetate; and hydrocarbon including gasoline for industrial use are employed. A solvent having a high boiling point, for example, phthalic acid compounds including butyl phthalate are mixed in the aforementioned organic solvent. Adding a proper amount of solvent having a higher boiling point to the organic solvent as a plasticizer provides a dried ink film with elasticity, thereby minimizing defects after drying, such as cracking.

Besides, adding a predetermined amount of resin to ink as required can improve a property of this film of dried ink. For example, adding cellulose resin, vinyl resin, petroleum resin or the like to ink improves a binding capacity of a printed film, and a film of dried ink is strengthened. In this case, selecting resin with as low molecular weight as possible sustains the viscosity of the ink so as not to exceed 10 poises. In a case that the resin to be added to ink contains hydroxyl group (OH-group), such as poly-vinylbutyral resin, a dispersion effect given by the resin itself greatly lowers viscosity of the ink, in spite of adding powders. For this reason, though powder having a high concentration is added, the ink maintains a viscosity below 10 poises.

Adding a predetermined amount of dispersant to ink as required can improve stability of the ink. Dispersants usable for organic solvent-based ink are: fatty ester; polyhydric alcohol fatty ester; alkyl glycerol ether and its fatty ester; lecithin derivatives; propyleneglycol fatty ester; glycerol fatty ester; polyoxyethylene glycerol fatty ester; polyglycerol fatty ester; sorbitol fatty ester; polyoxyethylene sorbitol fatty ester; polyoxyethylene sorbitol fatty ester; polyethylene glycol fatty ester; polyoxyethylene alkyl ether, or the like. Adding these dispersants to ink improves dispersion and prevents powders from re-aggregation and precipitation. Adding ethylcellulose resin or polyvinyl butyral resin to ink improves a binding capacity and a dried ink film is strengthened. In adding such dispersants to ink, employing resin, which forms a film as ink dries, strengthens a film of ink. Besides, a proper combination of a dispersant and a powder can considerably lower viscosity of ink. Considering this, adding a dispersant to ink provides benefits.

Metallic powder mixed in ink preferably has a particle diameter ranging from 0.001 to 10 μm; a metallic powder with a particle diameter not more than 0.001 μm cannot maintain a property as metal at ordinary temperatures. In particular, in a case of metallic material, for example, silver and base metal including nickel, copper, aluminum, zinc, and an alloy powder formed of these metals, a surface thereof is easily oxidized or hydro-oxidized in air. According to analysis performed by a surface analyzer (ESCA and the like), the inventors found that, in a metallic powder with a particle diameter less than 0.001 μm, not only a surface layer but also an inner part of the powder has been affected by oxidization or hydro-oxidization. A metallic powder with a particle diameter less than 0.001 μm having no oxidization or hydro-oxidization—with the exception of precious metal, such as gold and palladium—easily catches fire, so that careful handling is required. The careful handling automatically increases cost. Therefore, such powders are not suitable for ink for electronic components of the present invention. The particle diameter of a metallic powder is preferably not more than 10 μm; a metallic powder having a particle diameter greater than 10 μm tends to precipitate in the ink. As a result, a metallic powder with a particle diameter ranging from 0.01 to 0.5 μm is preferably employed for the ink of the present invention. Such a powder exhibits easy handling a and reasonable cost, which contributes to low cost electronic components.

An amount of metallic powder to be added to ink preferably ranges from 1 weight % to 80 weight % of ink. An amount of powder less than 1 weight % cannot often provide electrical conduction after baking. On the other hand, an amount of powder more than 85 weight % increases viscosity of the ink to over 2 poises, or renders the ink easy to precipitate. For the ink for electronic components of the present invention, the amount of powder to be added to ink more preferably ranges from 5 weight % to 60 weight %. Adding powder within this range allows the ink to be easily and economically made, which contributes to cost-lowered electronic components. As another benefit, this contributes to a longer-period storage of the ink.

In a case that the ink for electronic components in which metallic powder (or, ceramic, glass, or resistant material powders, which will be described below) is added, in the range from 1 weight % to 80 weight %, to the ink, a temperature for thermal process is preferably higher than 50° C. When thermosetting resin is employed, a curing temperature preferably ranges from 50° C. to 250° C. At temperatures lower than 40° C. a curing time becomes too long to be practical in a manufacturing process. On the other hand, resin decomposes at temperatures higher than 300° C. When the resin is baked (or volatilized, or burnt off, the temperature preferably ranges from 250° C. to 1500° C. The resin is hard to decompose at temperatures less than 200° C. A process at temperatures more than 1600° C. is not practical because it exceeds a melting point of metallic powders.

When silver is employed for the ink, migration or silver-sulfidation often occur. However, silver is suitably used, due to its advantageous properties of low conductor resistance and high solder wettablity, for inner electrodes of a coil and various kinds of filters having a monolithic structure. Like silver, copper provides properties of low conductor resistance and high solder wettablity. Therefore, by employing copper high-performance electronic components are produced through baking in nitrogen gas or the like.

Tenth Embodiment

In a tenth embodiment an aqueous ink for electrodes (or metallic powder ink) is used. This embodiment differs from the ninth embodiment in that an organic solvent ink is used. An aqueous ink for electrodes suggested in the embodiment provides manufacture of electronic components having respect for environmental protection and fire regulations.

A detailed explanation will be given hereinafter. First, aqueous nickel (Ni) ink was prepared as the ink for electrodes. Ni powder (100 g) with a particle diameter of 0.5 μm was added to a mixed solution (200 g) made of pure water containing a small amount of additives and an aqueous organic solvent. Next, the solution having the Ni powder was subject to dispersion for hours with 0.5 mm diameter zirconium beads. Then, the solution was filtered by a 5 μm membrane filter to form aqueous ink 12 with a viscosity of 0.02 poises.

Now will be described how to make an organic ceramic green sheet. First, prepare a barium titanate dielectric powder with a particle diameter of 0.5 μm. The dielectric powder has X7R property—a property in which a rate of change of capacity maintains within ±15% at temperature ranging from −55° C. to 125° C. In order to form a dielectric slurry, disperse the dielectric powder with butyral resin, phthalate plasticizer, and an organic solvent. Then filter the slurry by a 10 μm filter and apply it onto a resin film. In this way, a ceramic green sheet with a thickness of 5 μm was produced.

Next, as shown in FIG. 1A and FIG. 2, aqueous ink 12 was directly jetted, as droplets 17, from printer head 16 onto the ceramic green sheet, that is, substrate 18. When strongly magnetized material, such as nickel and iron, is employed, an ultrasonic dispersing unit is preferably used as dispersing unit 22. When a magnetically dispersing unit, such as a magnet stirrer, as is used in the ninth embodiment, is employed for dispersing unit 22 to disperse ink 12 containing such strongly magnetized powders, nickel or other strongly magnetized material is attracted to a magnet rotor. This allows ink 12 to easily form precipitate 14.

In this way, a laminated ceramic capacitor is produced in a like manner with the ninth embodiment. As a result, higher than a 95% yield of products was achieved. On the other hand, with the ink for electrodes employed in the ninth embodiment, another laminated ceramic capacitor having a thickness of 5 μm was produced. In this case, the yield of products was not more than 50%. As a result of investigation about this failure, the inventors concluded that the organic solvent contained in the ink for electrodes dissolved the ceramic green sheet. Using aqueous ink depending on a structure of the ceramic green sheet—differences in components of resin, density, concentration, and air permeability—and on the thickness of the sheet, the yield of electronic components is improved. Besides, in the case of using aqueous ink, adding an aqueous organic solvent as required, such as glycerol and glycol, to pure water, ion exchange water, or distilled water improves stability of the ink, thereby minimizing a problem of ink drying or ink sticking at the printer head.

An ink having viscosity ranging from 0.005 to 10 poises is preferable for ink for ink jet printing. In a case of adding powders to a solvent, it is generally known that viscosity increases as an amount of the powder added to the solvent and a volume percentage of the amount to the total amount increase—see Einstein's viscosity formula. For example, water has a viscosity of 0.089 poises at 25° C. After ceramic powder or metallic powder is added to the water as a solvent, it would be difficult to maintain the viscosity of the ink lower than 0.005 poises. An ink with viscosity higher than 10 poises is too viscous to provide ink jetting with stability from a narrow ink jet nozzle. Even if the nozzle manages to jet the ink, a residue of the ink remains around the nozzle when the nozzle jets the ink, due to lack of sharpness in ink jetting. This ink stuck nozzle cannot jet ink in a proper direction, whereby precision in printing is degraded. This invites a failed printed pattern due to oozing or dripping of ink. The ink for electronic components of the present invention tends to have thixotropy—a phenomenon in which viscosity varies depending on a shearing stress. This makes it difficult to exactly investigate the viscosity of ink. In the ink having thixotropy, the shearing stress by which the viscosity is estimated is preferably fitted with a range of the shearing stress at ink jetting from the printer head. An experiment performed by the inventors found that determination of the viscosity of ink was preferably done at a shearing rate in a high-speed range of 10000 per sec.

Eleventh Embodiment

In using the aqueous ink described in the tenth embodiment, adding a required amount of a soluble organic solvent (such as, ethylene glycol, glycerol, or polyethylene glycol), as a plasticizer other than water, can provide a film of dried ink with elasticity. That is, this minimizes defects such as cracking after the ink has dried on a surface of a substrate.

The ink for electronic components can be circulated with pressure by air or the like, instead of a pump. This is easily done by application of pressure with air or nitrogen gas to ink in a pressurized tank.

In addition, the ink for electronic components does not need to have continuous circulation; the circulation can be stopped as required while ink jet printing is in operation. Making a stop does no harm to an amount of ink jetted from the printer head during printing. The ink can be circulated even in a brief stop during printing—for example, an interval in which the printer head performs carriage return in one way printing, or an interval in which the printer head moves to a next line in two-way printing. It is also possible that a circulation amount of ink or a flow amount of ink per unit time can be controlled according to printing conditions; the amount of flow of ink can be increased while the printer is at a standstill, for example, during a time of exchanging or carrying substrates in a manufacturing process. On the other hand, the amount of flow of ink can be decreased while the printer performs printing with high precision. Intentionally increasing the amount of flow of ink or increasing pressure for delivering ink can spout ink 12 from printer head 16, in an abundance of drips or mists, without an electric signal from outside. Printer head 16 can thus be cleaned. This cleaning is effective in removing ceramic powder or glass powder that often sticks to an inner wall of ink spouting section 28.

Twelfth Embodiment

Using magnetic powder or glass powder other than ceramic powder can form various types of electronic components and optical parts. Here in a twelfth embodiment resistor ink is explained. To prepare a resistor, various additives were added to ruthenium oxide ($RuO_2$)-powder or pyrochlore ($Bi_2RuO_7$)-powder to form resistor powder having a sheet resistance ranging from 0.1Ω/□ to 10 MΩ/□; where, Ω/□ represents a resistance value determined in a unit area at thickness of 10 μm, which can be measured by a commercially available sheet resistance measurer. As for a major constituent forming the resistor, metallic material, such as silver (Ag), palladium (Pd), silver palladium (AgPd); rutile oxide, such as $RuO_2$, $IrO_2$; pyrochlore oxide, such as $Pb_2Ru_2O_6$, $Bi_2Ru_2O_7$; or ceramic material, such as SiC can be employed. As for glass powder, Pb—$SiO_2$—$B_2O_3$ was used. In order to strengthen bonding between an alumina substrate and the resistor and control Temperature Coefficient of Resistance (TCR), $Bi_2O_3$, CuO, $Al_2O_3$, $TiO_2$, ZnO, MgO, or $MnO_3$ was added. Furthermore, to make a fine adjustment to TCR so as to be less than 25 ppm, additives with which TCR is pulled in a negative direction—such as Ti, W, Mo, Nb, Sb, Ta—and additives with which TCR is pulled in a positive direction—such as Cu, Co—are each slightly added to this resistor powder. In this way, various kinds of resistor powder (mother powder) ranging from low sheet resistance (of less than 0.1Ω/[ ]) to high sheet resistance (of more than 10 MΩ/□) were manufactured.

As a next step, cellulose resin and an organic alcoholic solvent as a major constituent were added to each resistor powder and then each powder was dispersed by a beads mill for hours with 0.5 mm diameter zirconium beads. Then, the powder was filtered by a 5 μm membrane filter to make resistor ink for ink jet printing, i.e., mother resistor ink with viscosity of 0.05 poises. Through mixture of the mother resistor ink having different sheet resistance, ink having an intermediate sheet resistance or having desired sheet resistance can be obtained.

The resistor ink was set to the ink jet apparatus of the present invention and ink jet printing was performed in a predetermined pattern on a some-centimeter square alumina substrate. On the substrate, a plurality of break lines was formed in advance. After that, a predetermined electrode pattern disposed so as to sandwich the aforementioned resistor pattern was jetted with the ink for electrodes, which was described in the ninth embodiment. Furthermore, glass ink was sprayed by ink jet printing so as to cover the resistor pattern and the electrode pattern to produce a chip resistor. Particularly in the embodiments of the present invention, printing patterns having difference in pitch or rank of break lines can be easily controlled by an external signal. Therefore, printing can accommodate variations in sizes of alumina substrates. In conventional screen printing, a substrate was given a rank corresponding to a size, so that a different screen plate had to be prepared for each rank. The present invention can eliminate the problems above; cost required in producing screen plates and exchanging plates can be lowered, and accordingly, maintenance work for the plates and storage space for the plates can also be decreased. This allows composite electronic components including a chip resistor to have a lower production cost. In the conventional screen printing, as cost-cutting measures, one production lot having 500 to 2000 alumina substrates has been printed with the same resistor pattern; whereas in this embodiment of the present invention, one production lot has one substrate, thereby allowing each substrate to have different resistor pattern. This will greatly contribute to small batches of a variety of products in a shorter delivery time.

Particularly in this embodiment of the present invention, the resistor ink forms the pattern on the alumina substrate without contact of the printer head with the substrate. When compared to conventional printing having contact between a printer and an object to be printed, such as screen-printing, non-contact printing can greatly decrease variations in resistance value. The conventional screen printing has provided a resistor with laser trimming to suppress the variations. However, this embodiment of the present invention achieved a desired resistance value with high precision without laser trimming. It has been generally known that providing a resistor with laser trimming degrades resistance against noise. This degradation is mainly caused by a fine crack occurring in an area with the trimming, or by Joule's heat locally generated at a partially thinned area by the trimming. This embodiment of the present invention can offer a process without laser trimming, thereby achieving superior performance against noise and pulse, and no degradation of durability results.

To adjust a resistance value to an intended value with precision, methods suggested by the inventors can be used. These are disclosed in Japanese Patent Application Non-examined Publication: No. H7-211507, No. H8-064407, No. H8-102401, No. H8-102402 and No. H8-102403.

Unlike the conventional method typified by screen printing, ink jet printing allows electronic components to be produced having no contact with a printing device, thereby decreasing variations in size and thickness of substrates. Besides, overlay printing can be easily performed. Furthermore, a printing pattern, precision in thickness of printed ink film, and a thickness of the film can be desirably changed by an external signal from a personal computer or the like. As a result, time required for changing a pattern can be decreased to half that of the conventional method. Processing various types of powder material, which have been basically employed in the conventional screen printing, by the ink-processing technique described in the present invention can optimize particle distribution and surface potential of powders. Through treatment for powders described above, the ink can be dispersed more highly than the conventional screen printing ink for electronic components, whereby precipitation is prevented effectively in the ink.

As a comparison experiment, a commercially available resistor paste and a screen-printing plate were set to a first screen printer to print a predetermined resistor. Next, the resistor paste and the screen printing plate used above were set to a second screen printer to print a predetermined resistor. In this way, printing of the resistor was repeated for ten screen printers. To minimize variations in resistors after baking, all resistors printed were baked at a single time in a furnace. Measurement of variations in the printers found variations, (i.e., individuality) ranging 10% to 15% in the printers. From a study of this result, the inventors concluded that differences in setting of a squeegee rubber, printing balance, and precision in the printers caused the variations in the printers.

Then, ten ink jet apparatuses printed the aforementioned resistor paste with a computer aided design (CAD) application. To minimize variations in resistors after baking, all the resistors printed were baked at a single time in a furnace. Measurement of variations in the printers found that the variations in the ink jet printers were less than 1%. Sharing a resistor ink and a pattern with a plurality of ink jet printers in ink jet printing can produce the same kind of electronic components in quantity in a short time. Furthermore, printing different patterns with different resistor ink by a plurality of ink jet printers can produce various kinds of electronic components with high efficiency.

Thirteenth Embodiment

In a thirteenth embodiment magnetic material ink is explained. First, as for magnetic material, ferrite powder of a zinc nickel (NiZn) system was employed. Compared to manganese zinc (MnZn) magnetic material, the NiZn magnetic material has good radio frequency characteristics and can be easily formed into a monolithic structure. The ferrite powder was dispersed in an organic solvent, as described in the twelfth embodiment, to experimentally make an organic solvent-based ferrite ink. In addition, an organic solvent-based silver ink was also prepared on a trial basis with reference to the ninth embodiment.

Next, the organic solvent ferrite ink and the organic solvent silver ink were alternately jetted so as to form a predetermined pattern by the ink jet apparatus. This ink jet printing formed a block structure containing a plurality of three dimensional structures, each of which further has a structure in which a coil printed with the silver ink is covered with the ferrite ink. The block structure was cut into predetermined pieces and then baked at a temperature of 900° C. in air. In this way, a monolithic LC filter (i.e., a filter having a combined structure of a coil and a capacitor) was produced.

As for the magnetic powder of the ink, NiZn ferrite powder should preferably be employed. MnZn ferrite material has to be baked at high temperatures or in a specific atmosphere, thereby increasing a production cost of electronic components such as an LC filter. Besides, the MnZn ferrite material has poor radio frequency characteristics when compared to the NiZn ferrite material. For this reason, the NiZn ferrite material is preferably employed for a high frequency filter suggested in the present invention or electronic parts for signal circuitry that carries small current less than 1 ampere. When necessary, for example, in manufacturing components for power supply unit or components carrying a large current more than 10 amperes, the MnZn ferrite powder is employed. Adding copper to the NiZn ferrite material can decrease a baking temperature or improve a degree of sintering. Such treatment allows magnetic material powder to have a preferable property for the ink for electronic components of the present invention.

Fourteenth Embodiment

In a fourteenth embodiment resin-based ink is explained. First, to prepare the ink, commercially available bisphenol A epoxy resin with low viscosity, which has an average molecular weight of about 350, was diluted with methyl ethyl ketone to obtain a solution having a viscosity of 0.05 poises. Next, the solution was filtered by a 5 μm membrane filter to make a resin ink for ink jet printing. The resin ink was jetted, as a protecting layer, by an ink jet apparatus onto a surface of the resistor described in the twelfth embodiment to form a predetermined pattern. A resistor first baked and then laser trimmed was used here. Such produced protecting layer was heated at 150° C. to set. As a comparing experiment, glass paste was printed, as a protecting layer, by the ink jet apparatus with a predetermined pattern onto a surface of the baked and then laser trimmed resistor. Then, the protecting layer melted at 600° C. and then hardened.

Such produced two chip resistors were compared with respect to each resistance value; one—having the resin protecting layer subjected heat treatment at 150° C.—maintained a resistance value that was measured at laser trimming. Whereas, the other one—having the glass protecting layer subjected heat treatment at 600° C.—had changes in resistance value by 0.1 to 0.2%. Although a degree of the change depended on the types of the resistor, changes were observed for all level of resistances—from low to high. An examination about a cause of the change found that the higher a thermosetting temperature, the greater the change in resistance value, when the resistor is subject to heat treatment beyond 400° C. The inventors concluded that this was caused by crystallization of a glass component of the resistor or changes in a degree of segregation of the resistor by application of heat beyond 400° C. In a heat treatment below 300° C., no change was observed within the measurement accuracy. As described in this embodiment, employing resin for the protecting layer of the resistor or the like can not only save energy but also minimize damage caused by heat to a device to be sealed.

Preferably, proper ceramic powder, desirably powder with a particle diameter less than 1 μm, should be added as filler to the resin ink for ink jet printing. This can match a coefficient of thermal expansion between a built-in device and electronic component, and can improve moisture resistance. A composition and manufacturing method of ceramic ink for ink jet printing described earlier can be used when the filler is dispersed in the resin ink. Besides, adding metallic powder enables the resin ink for ink jet printing to have conductivity. This is advantageous in mounting electronic components onto a print circuit board; a pattern formed into a given shape by ink jet printing with the conductive resin ink can be set by application of heat or light, thereby eliminating a soldering process.

Fifteenth Embodiment

Here in a fifteenth embodiment glass ink is explained. First, as glass powder, commercially available borosilicate glass powder (particle diameter: 20 μm) was employed. Next, water (200 g) and a soluble organic solvent (20 g)—polyethylene glycol with molecular weight of 200 was employed—and ammonium polycarboxylic acid (5 g) as a dispersant were added to the glass powder (100 g). Then, zirconium beads with a particle diameter of 1 mm (500 g) were added to this solution. The solution was dispersed for one hour using a commercially available beads mill and then filtered by a 5 μm membrane filter to obtain the glass ink. According to a measurement of particle distribution of glass powders included in a glass ink, average particle diameter of the glass powder was 0.5 μm. The Zeta potential was −60 mV. In measurement of equipotential point, no equipotential point was observed in pH 2 through pH 10. The glass ink produced by this process had no precipitation for more than one hour. Even if precipitates appeared in the ink, it was easily dispersed by a light stir and was filtered by the 5 μm membrane filter. A stabilized, that is, hard-to-precipitate glass ink was thus produced.

Next, the glass ink was jetted, by the ink jet apparatus of the present invention, with a predetermined pattern on a resistor—which was printed by ink jet printing then baked as described in the twelfth embodiment—to form a protecting layer. This printed pattern was then baked to produce a predetermined chip resistor.

To compare a result from the method of the present invention with that from a conventional method, commercially available glass ink was printed onto a baked resistor by the conventional screen printing. In order to measure elongation, i.e., deformation of a printing plate of the screen printing, a size of the printing plate was measured before printing. Measurement after performing a printing operation ten times found that deformation per 10 cm square measured within ±2 μm. The deformation is smaller than a detection limit of an X-Y dimension measurer used. However, in measurements after performing a printing operation 100 times and 200 times, deformation of 50 to 100 μm per 10 cm square was observed. This deformation degrades an adjustment accuracy between the plate and the resistor, thereby decreasing yields of products.

Next, measurement of deformation, as is the case of the conventional screen printing, was performed with respect to a pattern jetted by ink jet printing with the glass ink of this embodiment of the present invention. Using a pattern produced by CAD on a personal computer, an ink jet apparatus performed continuous printing, with a measurement of a pattern size being performed at completion of a first, tenth, hundredth, one thousandth, ten thousandth, and one hundred thousandth pattern. All of the measurements above showed that deformation per 10 cm square measured within ±2 μm. Furthermore, this glass ink pattern was printed by a plurality of ink jet printers to measure variations of print sizes in the printers. This measurement showed again that the variations per 10 cm square was less than ±2 μm. This result proved that no substantial variations occurred in the printers.

Although each of powders used in the present invention is referred to, for convenience sake, as glass powder, ceramic powder, and magnetic powder of an intended use, they are all oxides. Therefore, a dispersing method and composition of ink used for the ceramic powder are applicable without modification to the glass powder and the magnetic powder.

As for glass material, lead borosilicate glass and zinc borosilicate glass are employed. When the material has poor adhesion, elements, such as copper (Cu), zinc (Zn), vanadium (V), can be added as required. As for ceramic material, ceramic powder for a varistor and piezoelectric element, other than a dielectric material including alumina powder, barium titanate, strontium titanate, was employed for the ink for electronic components. As for magnetic material, commercially available ferrite—Ni-base, Mg-base materials or the like—is used for the ink for electronic components. An ink jet apparatus equipped with the ink circulating mechanism described in the first embodiment or the others copes well with such conventional material, which is reliably used and maintains a constant production, and offers stabilized printing. As a result, various laminated ceramic electronic components, LC filters, noise filiters, radio frequency filters, and composite structure of aforementioned components can also be manufactured with high productivity.

Sixteenth Embodiment

A sixteenth embodiment takes ink jet printing as an example of an on-demand printing technique. In the conventional printing, an original plate reproduces a plurality of patterns. The on-demand technique is printing in which CAD data or image data stored in a PC is directly printed onto a substrate with printers for high volume printing. Specifically, printers suitable for the on-demand technique include a thermal transfer printer, an ink jet printer, and a laser beam printer that can quickly print a required amount of required patterns. In this embodiment, soluble ink for electrodes, with viscosity kept below 1 poise, was generated and set in a commercially available ink jet printer. In response to a signal from a PC, the ink was directly jetted onto a green sheet to form a predetermined inner electrode. Similarly, through processes of laminating, baking, and forming external electrodes, a laminated ceramic electronic component can be produced. Based on data obtained from a manufacturer through communications, the on-demand technique can complete a product with an extremely fast delivery time. Besides, as for some parts forming electronic components, the technique suggested in the present invention offers an opportunity in which prototype manufacturing of some devices can be performed by a user of electronic components within their factories, other than the prototype manufacturing by a manufacturer of the components. In a case that a user produces a prototype of a device, a manufacturer used to have to offer various types of ink for printing with stability. The present invention equipped with the ink circulating mechanism can eliminate various processes for controlling a condition of ink that are bothersome for users. As long as the same ink is employed, a stabilized quality enables in situ manufacturing of electronic components regardless of users or production sites at home as well as abroad. Going public parameters or characteristics—for example, a solubility parameter—with respect to prototype manufacturing of ink for various electronic components offers a smooth communication between user and manufacturer to encourage production of new electronic components.

Seventeenth Embodiment

Figure 12:
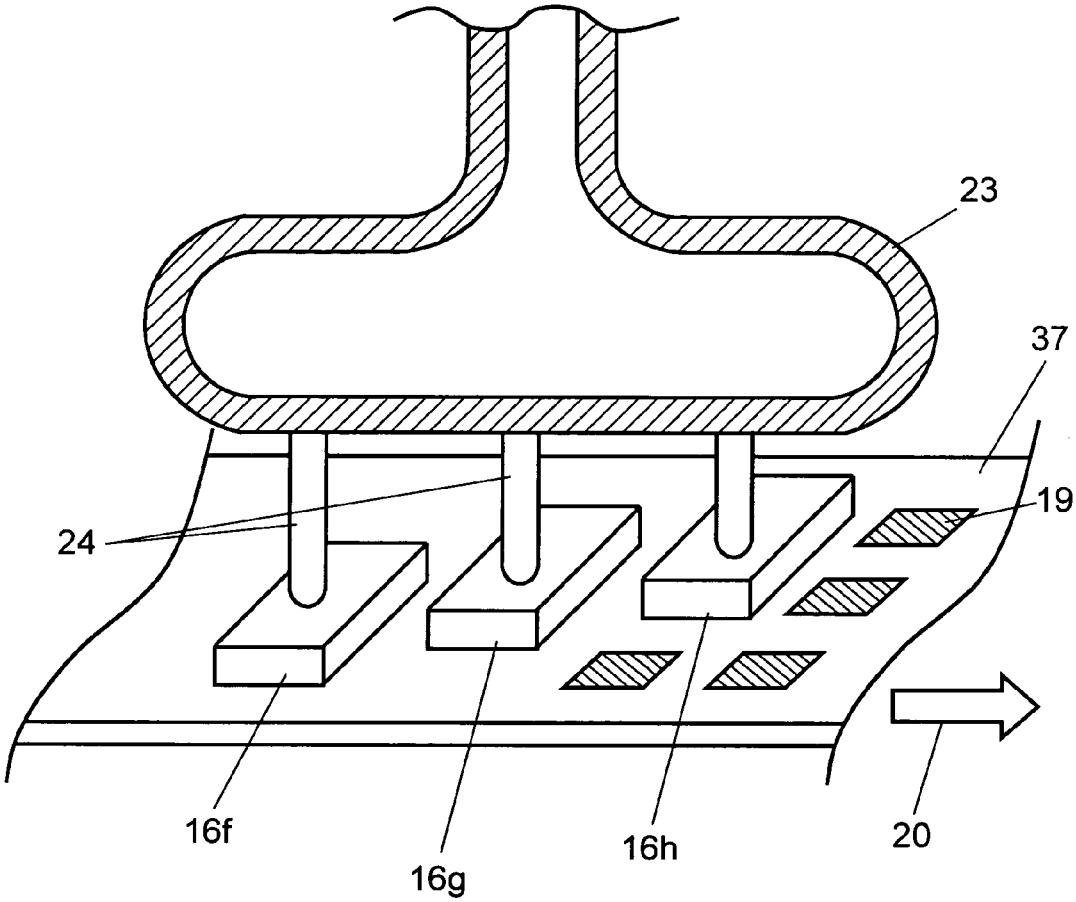
FIG. 12 shows a process in which a plurality of heads in a side-by-side arrangement produces a wide pattern in one operation.

A seventeenth embodiment describes in detail a case in which a plurality of printer heads is employed, with reference to FIG. 12. FIG. 12 shows a process in which a plurality of heads produces a wide pattern in one operation. As shown in FIG. 12 a substrate 37 moves in a direction indicated by arrow 20. In this process, ink (not shown) jetted from printer heads 16*f*, 16*g*, and 16*h* forms predetermined ink pattern 19 on a surface of substrate 37. The ink (not shown) circulating in first tube 23 is fed to printer heads 16*f*, 16*g*, and 16*h* through second tube 24. An arrangement in which a plurality of heads covers the same print range can print a wide pattern at a time. The pattern formed on the substrate is made of the same ink jetted from these three different heads. Forming a pattern with the same ink can minimize variations of characteristics in electronic components with respect to a printed location.

If necessary, a filter can be attached at a midpoint of second tube 24. An experiment performed by the inventors found that bubbles appear in an upper flow in the first tube 23. Therefore, connecting second tube 24 to a bottom (lower section close to the bottom, or lower side) of first tube 23, as shown in FIG. 12, can prevent bubbles from entering into second tube 24, even if fine bubbles intrude in first tube 23. This can provide stabilized printing for long hours, thereby decreasing a production cost of electronic components. Particularly in the present invention, first tube 23 is not directly connected with printer heads 16*f*, 16*g*, and 16*h*, but connected to them through second tube 24. This structure can offer stabilized printing as described in each embodiment.

In order to print a broader width with precision by this arrangement of a plurality of printer heads, moving the substrate is preferable. Moving the printer heads at a high speed often causes undesirable deflections in a position of the printer heads.

Eighteenth Embodiment

Figure 13A:
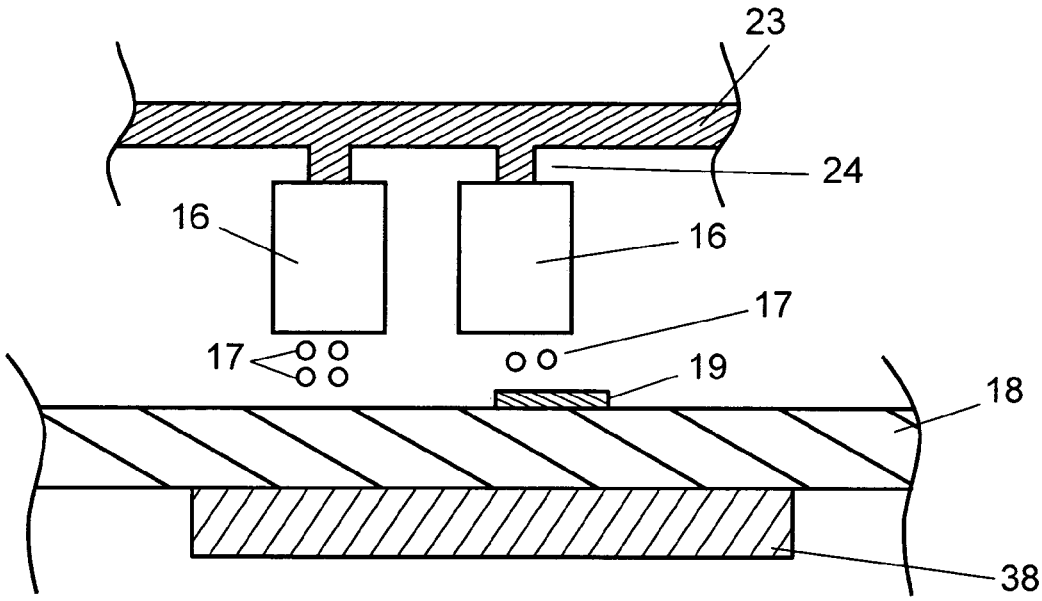
FIGS. 13A and 13B show a process in which an ink pattern is multi-layered on a fixed table.
Figure 13B:
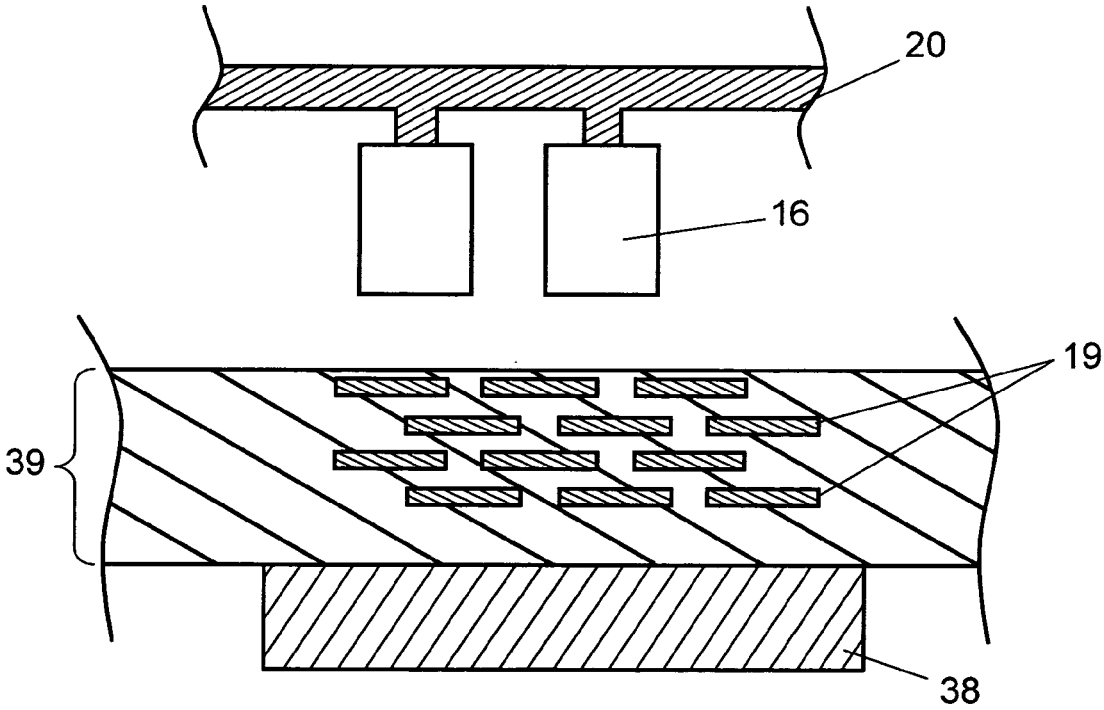

An eighteenth embodiment describes in detail a method of manufacturing laminated components using the ink jet apparatus of the present invention, with reference to FIGS. 13A and 13B. FIG. 13A shows a process in which a multilayer pattern is formed on a fixed table. In FIG. 13A, substrate 18 is temporarily fixed on fixed table 38. Ink is fed from first tube 23 to be distributed to plural printer heads 16 through second tubes 24. Droplets 17 jetted from each of printer heads 16 meets on a surface of substrate 18 to form ink pattern 19. By laminating a ceramic green sheet on ink pattern 19 thus produced and forming another ink pattern 19 on this laminated ceramic green sheet, a multi-laminated structure 39 is formed as shown in FIG. 13B. After being cut into a predetermined shape, multi-laminated structure 39 is baked to form external electrodes, whereby an electronic component is manufactured. In this case, multi-laminated structure 39 can be cut into a predetermined shape on fixed table 38 before this baking process. Multi-laminated structure 39 should preferably be subjected to the baking process after being removed from fixed table 38.

Ink tank 21 and ink-collecting tank 25 in FIG. 2 do not necessarily have separate structure—one tank can be ink tank 21 and ink-collecting tank 25 at the same time, provided that a filter is disposed in a middle of the first tube 23 and the ink is circulated through the first tube by a pump.

INDUSTRIAL APPLICABILITY

The ink jet apparatus of the present invention, as described above, can cope well with ink for electronic components, which tends to form precipitates or aggregates due to its high concentration, thereby providing ink jet printing with stability. A production range is extended—not only laminated ceramic electronic components typified by a laminated ceramic capacitor—to radio-frequency components, optical components, LC electric filters, three-dimensional composite electronic components, and devices combined with various conductors. Besides, a required amount of components above can be manufactured in a very short time on an on-demand basis. It is therefore possible to manufacture products with high yields, and reliability, but with low production costs.

The invention claimed is:

1. An ink jet apparatus comprising:

(a) an ink tank storing ink therein;

(b) an ink-collecting tank connected to said ink tank via a first tube;

(c) a printer head connected to said first tube via a second tube;

(d) a dispersing unit for dispersing the ink; and (e) a bubble-trapping unit disposed on said first tube, said bubble-trapping unit including a reversed U-shaped portion of said first tube, such that upon operation of the ink jet apparatus, the ink circulates through said tubes and a portion of the ink is jetted from said printer head as required.

2. The ink jet apparatus according to claim 1, wherein said dispersing unit is fixed to disperse the ink while in said ink tank.

3. The ink jet apparatus according to claim 1, wherein said dispersing unit is fixed to disperse the ink while in said first tube.

4. The ink jet apparatus according to claim 1, further comprising:

a pump fixed to at least one of said first tube and said second tube for inducing the ink to flow.

5. The ink jet apparatus according to claim 1, further comprising:

a valve fixed to at least one of said first tube and said second tube for controlling flow of the ink.

6. The ink jet apparatus according to claim 1, further comprising:

another printer head connected to said first tube via another second tube.

7. The ink jet apparatus according to claim 1, wherein said first tube has an inner diameter ranging from 0.2 mm to 50 mm, and said second tube has an inner diameter ranging from 0.1 mm to 10 mm.

8. The ink jet apparatus according to claim 1, wherein said first tube is transparent.

9. The ink jet apparatus according to claim 1, wherein a part of said first tube is flexible.

10. The ink jet apparatus according to claim 1, wherein said printer head includes an ink jet nozzle for jetting the ink, and a piezoelectric element for applying pressure to the ink.

11. The ink jet apparatus according to claim 1, further comprising:

a third tube disposed to connect said ink tank with said ink-collecting tank.

12. The ink jet apparatus according to claim 11, wherein said third tube has a pump.

13. The ink jet apparatus according to claim 11, wherein said third tube has an ink-recycling unit.

14. The ink jet apparatus according to claim 11, wherein said third tube has a valve for controlling flow of the ink.

15. The ink jet apparatus according to claim 11, wherein said third tube has a filter.

16. The ink jet apparatus according to claim 1, further comprising:

a filter fixed to at least one of said first and said second tube.

17. An ink jet apparatus comprising:

(a) an ink tank storing ink therein;

(b) an ink-collecting tank connected to said ink tank via a first tube;

(c) a printer head connected to said first tube via a second tube;

(d) a dispersing unit for dispersing the ink;

(e) a third tube disposed to connect said ink tank with said ink-collecting tank; and (f) an ink-recycling unit coupled to said third tube, such that upon operation of the ink jet apparatus, the ink circulates through said tubes and a portion of the ink is jetted from said printer head as required.

18. An ink jet apparatus comprising:

(a) an ink tank storing ink therein;

(b) an ink-collecting tank connected to said ink tank via a first tube;

(c) a printer head connected to said first tube via a second tube;

(d) a dispersing unit for dispersing the ink;

(e) a third tube disposed to connect said ink tank with said ink-collecting tank; and (f) a filter coupled to said third tube, such that upon operation of the ink jet apparatus, the ink circulates through said tubes and a portion of the ink is jetted from said printer head as required.

* * * * *